US005521683A

United States Patent [19]

Miyamoto et al.

[11] Patent Number: 5,521,683

[45] Date of Patent: May 28, 1996

[54] IMAGE FORMING APPARATUS USING CONSTANT VOLTAGE OR CONSTANT CURRENT AC SIGNAL APPLIED TO DEVELOPER BEARING MEMBER, AND CONTROL FUNCTION IN ACCORDANCE WITH DETECTED VOLTAGE OR CURRENT OF DEVELOPER BEARING MEMBER

[75] Inventors: Toshio Miyamoto; Akihiko Takeuchi; Katsuhiko Nishimura, all of Yokohama; Kazuaki Ono, Tokyo; Minoru Matsuguma, Kawasaki, all of Japan

[73] Assignee: Canon Kabushiki Kaisha, Tokyo, Japan

[21] Appl. No.: 168,123

[22] Filed: Dec. 17, 1993

[30] Foreign Application Priority Data

Dec. 21, 1992 [JP] Japan ..... 4-355442

[51] Int. Cl.[6] ..... G03G 15/06

[52] U.S. Cl. ..... 355/246; 355/208

[58] Field of Search ..... 355/208, 245, 355/246; 118/652, 657, 658

[56] References Cited

U.S. PATENT DOCUMENTS

| | | | |
|---|---|---|---|
| 4,292,387 | 9/1981 | Kanbe et al. | 430/102 |
| 4,324,199 | 4/1982 | Morikawa | 118/658 |
| 4,373,468 | 2/1983 | Suda et al. | 118/658 |
| 4,395,476 | 7/1983 | Kanbe et al. | 430/102 |
| 4,422,749 | 12/1983 | Hoshino et al. | 355/3 DD |
| 4,600,295 | 7/1986 | Suzuki | 355/14 D |
| 4,870,460 | 9/1989 | Harada et al. | 355/246 |
| 4,942,429 | 7/1990 | Kakitani | 355/208 |
| 4,975,746 | 12/1990 | Miyauchi et al. | 355/245 |
| 4,989,044 | 1/1991 | Nishimura et al. | 355/251 |
| 5,066,979 | 11/1991 | Goto et al. | 355/208 |
| 5,134,441 | 7/1992 | Nagata et al. | 355/245 |
| 5,177,537 | 1/1993 | Okano et al. | 355/259 |
| 5,185,496 | 2/1993 | Nishimura et al. | 118/658 |
| 5,202,729 | 4/1993 | Miyamoto et al. | 355/251 |
| 5,365,316 | 11/1994 | Motoyama et al. | 355/246 X |
| 5,369,472 | 11/1994 | Raj et al. | 355/208 |

*Primary Examiner*—Fred L. Braun

*Attorney, Agent, or Firm*—Fitzpatrick, Cella, Harper & Scinto

[57] ABSTRACT

A bias voltage including an AC voltage component is applied to a development sleeve. When the development sleeve opposes a non-image region of a photosensitive drum, a reference bias voltage including a constant current AC voltage component or a reference bias voltage including a constant voltage AC voltage component is applied to the development sleeve, and an AC voltage value or an AC current value applied to the development sleeve at that time is detected. An image formation factor is controlled on the basis of the detected AC voltage value or the detected AC current value.

14 Claims, 28 Drawing Sheets

IMAGE FORMING APPARATUS USING CONSTANT VOLTAGE OR CONSTANT CURRENT AC SIGNAL APPLIED TO DEVELOPER BEARING MEMBER, AND CONTROL FUNCTION IN ACCORDANCE WITH DETECTED VOLTAGE OR CURRENT OF DEVELOPER BEARING MEMBER

BACKGROUND OF THE INVENTION

1. Field of the Invention

The present invention relates to an image forming apparatus for applying a periodic bias voltage to a development agent bearing member which bears and conveys a development agent, and applies the development agent to an electrostatic latent image bearing member in a development region.

2. Related Background Art

It is well known to apply a periodic bias voltage obtained by superposing an AC voltage component such as a sine wave, a rectangular wave, a triangular wave, or the like on a DC voltage component to a development agent bearing member such as a development sleeve, a development roller, and the like (U.S. Pat. Nos. 4,292,387, 4,395,476, and 4,600,295).

The DC voltage component contributes to fog prevention, improvement of the density of a developed image, and optimization of the line width of a line image, while the AC voltage component activates motion of a development agent in the development region, thus contributing to improvement of the density and gradation of a developed image, prevention of a decrease in line width of a line image, and the like.

On the other hand, the following technique is also known. In this technique, spacer rollers are provided to the two end portions of a development agent bearing member so as to maintain a gap between an image bearing member and the development agent bearing member, and the spacer rollers are pressed against the image bearing member (U.S. Pat. Nos. 4,324,199 and 4,373,468).

After repetitive use of the apparatus, when the spacer rollers and/or the pressing portions between the image bearing member and the spacer rollers gradually wear out, the gap between the image bearing member and the development agent bearing member in the development region changes from an initial value.

In this case, since the periodic electric field strength on the development region changes from an initial value, the line width of a developed line image, and the density of a developed solid or whole image undesirably change from initial values.

Also, an image forming apparatus, which can detachably mount a so-called process cartridge which integrally holds an image bearing member and a development device, and also integrally holds a charger and/or a cleaner, if necessary, is known (U.S. Pat. Nos. 4,975,746 and 5,134,441).

The gap between the image bearing member and a development agent bearing member may vary for individual cartridges due to manufacturing errors. In this case, since the periodic electric field strength varies for individual cartridges, the line width and the density of a developed image undesirably vary depending on the cartridges.

SUMMARY OF THE INVENTION

It is an object of the present invention to provide an image forming apparatus, which applies a vibration bias voltage to a development agent bearing member, and which can suppress a change in density or line width of a developed image even when the gap between the development agent bearing member and an image bearing member changes.

It is another object of the present invention to provide an image forming apparatus, which detachably mounts a process cartridge including at least an image bearing member and a development device, and which can suppress a change in density or line width of a developed image even when a process cartridge is used in which the gap between the image bearing member and a development agent bearing member is different from a reference value.

DESCRIPTION OF THE PREFERRED EMBODIMENTS

An image forming apparatus to which the present invention is applied will be described below with reference to FIG. 1.

Figure 1:
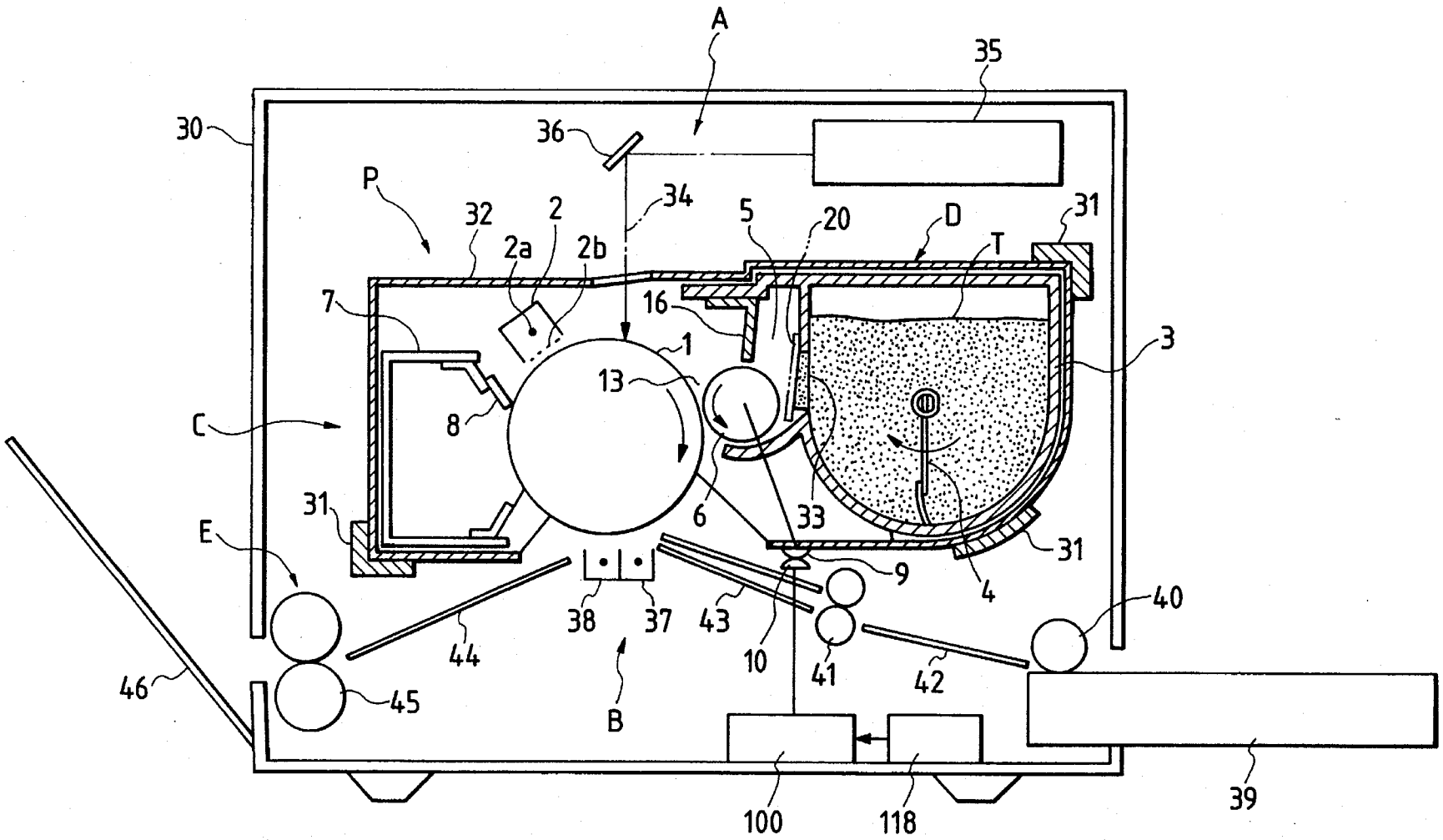
FIG. 1 is a sectional view of for explaining an example of an image forming apparatus to which the present invention can be applied.

Referring to FIG. 1, an image forming apparatus main body 30 has an optical device, a transfer medium conveying device, a transfer device, a fixing device (these devices will be described below), a power source 100, a controller 118 (these devices will be described later), and a guide member 31 for guiding attachment/detachment of a process cartridge P to the main body 30.

The process cartridge P has a cylindrical, i.e., drum-shaped electrophotography photosensitive body 1 which is rotated in the direction of an arrow, a charger 2 for uniformly charging the photosensitive body 1, a development device D for developing an electrostatic latent image formed on the photosensitive body 1, and a cleaning container 7 having a cleaning blade 8 for removing residual toner on the surface of the photosensitive body 1 after a developed image is transferred. These means are integrally supported in a molded synthetic resin frame member 32. The process cartridge P slides along guide member 31, and is loaded/unloaded into/from the main body 30. With this arrangement, for example, when toner in the development device D is used up, an operator unloads the process cartridge P outside the main body 30, and loads new process cartridge P filled with a toner in the development device into the main body 30. Alternatively, an operator loads a process cartridge P which stores desired color toners into the apparatus main body 30, thus allowing a desired color image to be output.

An electrical contact 9 for transmitting a development bias voltage to a sleeve 6 is provided on the outer surface of the frame member 32 of the process cartridge P. When the process cartridge P is loaded into the main body 30, the electrical contact 9 is connected to an output contact 10 of the power source 100. In this state, the power source 100 can supply a periodic bias voltage to the sleeve 6.

The development device D comprises a toner container 3 for storing a toner T, a stirring member 4 rotatably arranged in the container 3, a development chamber 5, and a development agent bearing member provided to the development chamber, i.e., a development sleeve 6 having an internal magnet. The stirring member 4 rotates in the direction of an arrow to stir the toner T in the container 3, and conveys the toner T to the development chamber 5 via an opening 33 formed in the wall of the container 3. The development sleeve 6 carries the toner conveyed into the development chamber 5, rotates in the direction of an arrow to convey the toner to a development portion (or region) 13, and applies the toner to an electrostatic latent image formed on the photosensitive drum 1, thereby developing the latent image.

In an unused process cartridge P, a seal member 20 is removably adhered on the side wall of the container 3, and seals the opening 33 to prevent the toner from leaking outside the container to contaminate portions inside and outside the cartridge, and from being wasted. At the beginning of use of a cartridge P, an operator removes the seal member 20 from the position of the opening 33 before or after he or she loads the cartridge P into the apparatus main body 30, so that the toner T can move from the container 3 to the development chamber 5. The seal member 20 may removably seal an opening portion of the development chamber 5 where the development sleeve 6 is arranged.

An image forming operation will be described below. The photosensitive drum 1 is charged by the charger 2, and is then exposed by scanning a laser beam 34 which is modulated in correspondence with an image information signal to be recorded. Thus, an electrostatic latent image is formed on the surface of the drum 1. The laser beam 34 is formed by a known optical device 35, such as a semiconductor laser, a rotary polygonal mirror, an f-θ lens, and the like, and is reflected by a mirror 36 in the direction of the photosensitive drum 1.

The electrostatic latent image is reversely developed by the development device D, as described above. The obtained developed image, i.e., a toner image, is transferred onto a transfer medium such as a paper sheet by the effect of a transfer charger 37. Then, the transfer medium is peeled away from the photosensitive drum 1 by the effect of a peeling charge remover 38. A device for conveying a transfer medium has a cassette 39 for storing transfer media, a pickup roller 40 for picking up a transfer medium from the cassette 39, a registration roller 41 for conveying a transfer medium to a transfer region in synchronism with the movement of a toner image, and convey guides 42, 43, and 44.

The transfer medium peeled from the photosensitive drum 1 is fed to fixing means E (a roller fixing device 45 in this embodiment) via the guide 44, and the toner image is fixed on the transfer medium by the device 45. The fixed transfer medium is discharged onto a tray 46.

In this embodiment, an exposure device exposes the photosensitive drum 1 with a laser beam. Alternatively, the photosensitive drum 1 may be exposed with light radiated from a light-emitting diode array which is driven by an image signal. Furthermore, an original image may be directly exposed onto the photosensitive drum 1 via a lens, and the formed electrostatic latent image may be normally developed by the development device D.

The above-mentioned cartridge P comprises the cleaning device 7 and the charger 2 in addition to the drum-shaped electrophotography photosensitive body 1 and the development device D. However, the present invention may be applied to an image forming apparatus using a process cartridge which has a photosensitive body and a development device, but does not have a cleaning device and/or a charger.

The development device D will be described in more detail below with reference to FIG. 2. For the sake of simplicity, the container 3 is illustrated simpler than that in FIG. 1.

Figure 2:
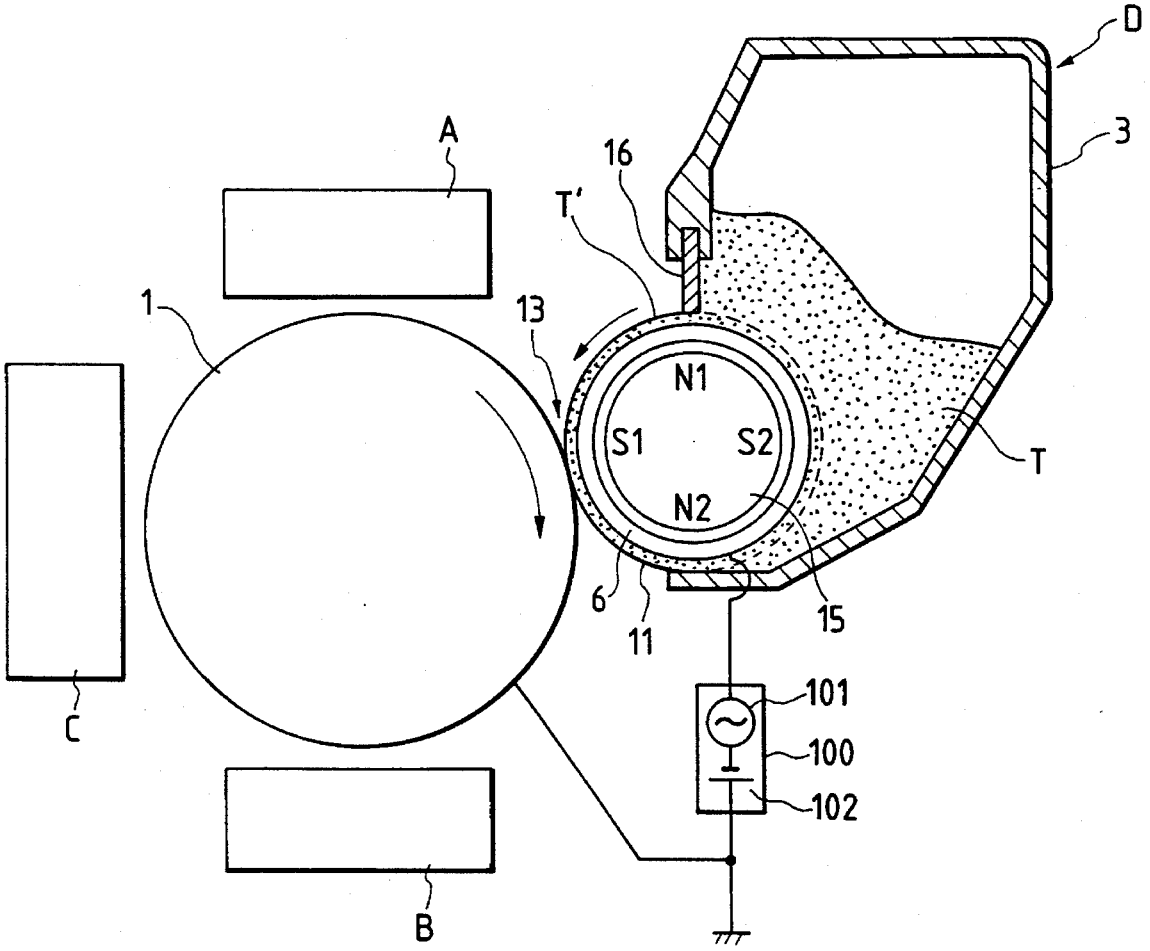
FIG. 2 is a partially cutaway side view for explaining an example of a development device which can be utilized in the present invention.

Referring to FIG. 2, a latent image forming means A comprises the charger 2 and exposure optical system components 35 and 36, a transfer means B comprises the charger 37 and the charge remover 38, and a cleaning means C comprises the blade 8 and the container 7. The development device D stores a development agent including no carrier particles, i.e., an insulative one-component magnetic development agent (toner) T in the container 3.

The toner T is charged to a polarity for developing an electrostatic latent image primarily by frictional contact with the sleeve 6. As the magnetic toner T to be used, for example, an insulative magnetic toner, which contains 60 wt. % of magnetite and 1 wt. % of a metal complex salt of a monoazo dye as a negative charge control agent in a binding resin containing a styrene-acrylic copolymer as the major component, and has a volume resistance of about $10^{13}$ Ωcm, is used as a base, and 0.4 wt. %, with respect to the toner weight, of silica fine particles subjected to a hydrophobic treatment are externally added to the above-mentioned toner so as to improve fluidity. This toner T is charged to a negative polarity by frictional contact with the sleeve 6.

The toner T is moved outside the container 3 by the non-magnetic sleeve (cylinder) 6 which is rotated in the direction of an arrow opposite to the rotational direction of the drum 1, and consists of aluminum, stainless steel, or the like, and is conveyed to the development portion 13. As the sleeve 6 to be used, an aluminum cylinder, whose outer shape is machined to have a diameter of 16 mm, may be sand-blasted using alundum abrasive grains (molundum A #400 available from Showa Denko (K.K.)) within a range of a length of 220 mm, across which the sleeve opposes the drum, and may have an arithmetical mean deviation from the mean line of the profile (Ra) of about 0.6 μm described in JIS B-0601. In the development portion 13, the photosensitive drum 1 and the sleeve 6 oppose each other via a minimum gap having a minimum interval of 50 to 500 μm. In this development portion 13, an electrostatic latent image is applied with and developed by the toner T.

In order to maintain the gap between the photosensitive drum 1 and the sleeve 6, the spacer rollers 11 are provided at the two end portions of the sleeve 6 coaxial with the sleeve 6, and are pressed against the two end portions of the photosensitive drum 1.

The thickness of a toner layer T' conveyed to the development portion 13 is regulated by a development regulating member (blade) 16. The blade 16 consists of a magnetic member such as iron, and opposes a magnetic pole $N_1$ of a stationary magnet 15 arranged in the sleeve 6 to sandwich the sleeve 6 therebetween. Therefore, lines of magnetic force from the magnetic pole $N_1$ are concentrated on the blade 16, and a strong magnetic curtain is formed between the blade 16 and the sleeve 6. With this magnetic curtain, a toner layer T' thinner than the gap between the blade 16 and the sleeve 6 is formed on the sleeve 6.

Note that the gap between the blade 16 and the sleeve 6 is set to be a value, so that the thickness of the formed toner layer T' can be smaller than the minimum gap of the sleeve 6 and the drum 1 (in this specification, the minimum gap between the sleeve and the drum will be referred to as an "SD gap" hereinafter). Note that the thickness of the toner layer may be regulated by an elastic blade pressed against the sleeve 6.

As described above, in the apparatus shown in FIG. 2, so-called non-contact development is performed. More specifically, since the thickness of the toner layer T' to be conveyed to the development region 13 is smaller than the minimum gap between the sleeve 6 and the drum 1, the toner flies from the sleeve 6 to the drum 1 via an air gap.

In order to improve development efficiency, and to form a high-density, clear, fog-free developed image, a periodic bias voltage is applied from the power source 100 (to be described later) to the sleeve 6. The periodic bias voltage is obtained by superposing an AC voltage on a DC voltage. The periodic bias voltage preferably includes a dark portion potential and a light portion potential of a latent image between its maximum and minimum values, and also preferably includes the DC voltage value between the dark and light portion potentials of a latent image. The frequency of the AC component of the vibration bias voltage is preferably set to fall within a range from 0.6 to 2.4 kHz, a peak-to-peak voltage (corresponding to the difference between the maximum and minimum values, and also called a peak threshold value) $V_{pp}$ is preferably set to fall within a range of from 0.4 to 2.0 kV, and the AC current value is preferably set to fall within a range of from 0.2 to 3.0 mA. As the waveform, a rectangular wave, a sine wave, a triangular wave, or the like is used. With this bias voltage, a magnetic field in a direction to generate a force directed from the sleeve 6 toward the drum 1, and an electric field in a direction to generate a force directed from the drum 1 to the sleeve 6 are alternately applied to the toner in the development region 13. Thus, the toner is actively reciprocally vibrated in the development region 13, thus obtaining a high-quality developed image.

The DC voltage component value of the periodic bias voltage is set to be an intermediate value between the light and dark portion potentials of a latent image. In the case of reversal development, the DC voltage component value is preferably set to be a value closer to the dark portion potential than the light portion potential, and in the case of normal development, the DC voltage component value is preferably set to be a value closer to the light portion potential than the dark portion potential in terms of fog prevention, improvement of the image density, prevention of a decrease in line width of a line image, and the like.

Note that "reversal development" means development for visualizing a latent image by attaching a toner charged to the same polarity as that of the latent image to a light portion potential region (a region exposed with light) of the latent image. On the other hand, development for visualizing a latent image by attaching a toner charged to a polarity opposite to that of the latent image to a dark portion potential region (a region not exposed with light) of the latent image is called "normal development".

In the development device D of this embodiment, a magnetic pole $S_1$ of the magnet 15 forms a magnetic field in the development portion 13 to prevent fog, thus allowing clear development of a line image. Magnetic poles $N_2$ and $S_2$ contribute to conveyance of the toner.

Figure 3:
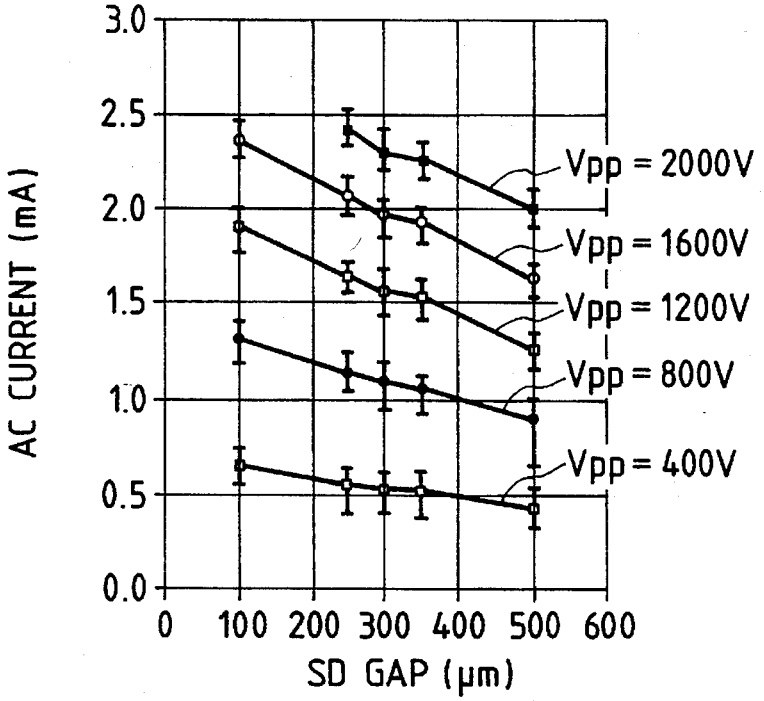
FIG. 3 is a graph for explaining the correlation between the SD gap and the AC current.

FIG. 3 shows the dependency between the SD gap size and the AC current value as a characteristic to be utilized by the present invention.

FIG. 3 shows the results obtained by applying rectangular wave AC voltages, which are respectively constant-voltage controlled to one of the five illustrated values, to the sleeve 6 when the sleeve 6 opposes a region where no electrostatic latent image is formed, i.e., a non-image region (a dark portion potential=−700 V) of the drum 1. Note that the AC frequency is 1.8 kHz in all cases.

Referring to FIG. 3, an AC current value (effective value) is obtained by plotting values measured by an AC ammeter which is inserted in series between a constant voltage AC power source and the sleeve 6, and each point is an average value obtained by rotating the sleeve 6 several times. The ammeter used was a 8062A TRUE RMS METER available from FLUKE Corp. Note that the SD gap (unit: μm) is plotted along the abscissa in FIG. 3, and the AC current value (effective value: mA) is plotted along the ordinate. The SD gap maintaining members (spacer rollers 11) were formed to have a deflection precision of about 10 μm.

As can be understood from this graph, when a constant AC voltage is applied, the AC current value changes due to, e.g., a difference in SD gap among individual cartridges. In other words, the SD gap size can be determined by measuring the AC current value.

Figure 4:
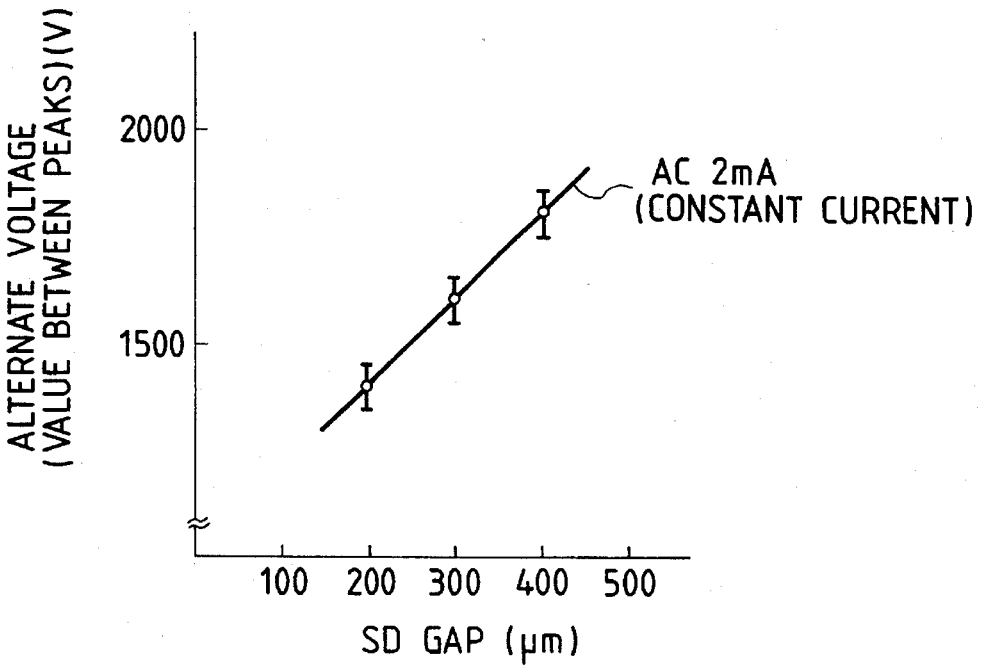
FIG. 4 is a graph for explaining the correlation between the SD gap and the AC voltage.

FIG. 4 shows the relationship between the SD gap and the AC voltage ($V_{pp}$) when the AC current value (effective value) is set to be 2 mA (constant). This graph is formed based on the graph in FIG. 3. As can be understood from FIG. 4, when the constant-current controlled AC voltage is applied to the sleeve, the AC voltage value ($V_{pp}$) changes in correspondence with the SD gap size. FIG. 4 indicates that when a constant AC current value is set, and an AC voltage at that time is measured, the SD gap size at that time can be uniquely determined.

The present invention controls image formation factors in correspondence with a change or difference in SD gap by utilizing the above-mentioned characteristic, thereby suppressing changes in line width and image density.

(Embodiment 1)

Figure 5:
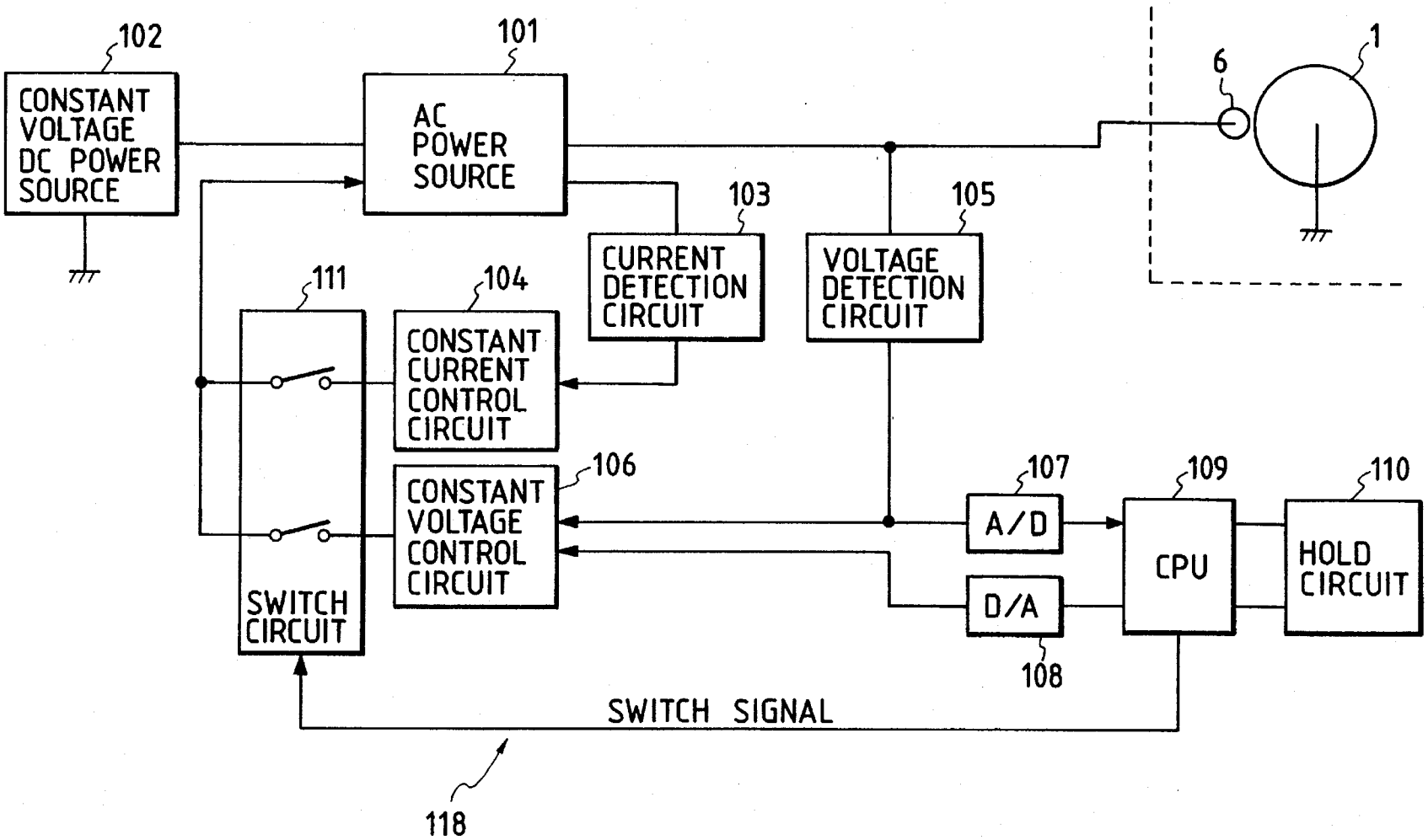
FIG. 5 is a block diagram for explaining a controller of embodiments 1 and 2.
Figure 6:
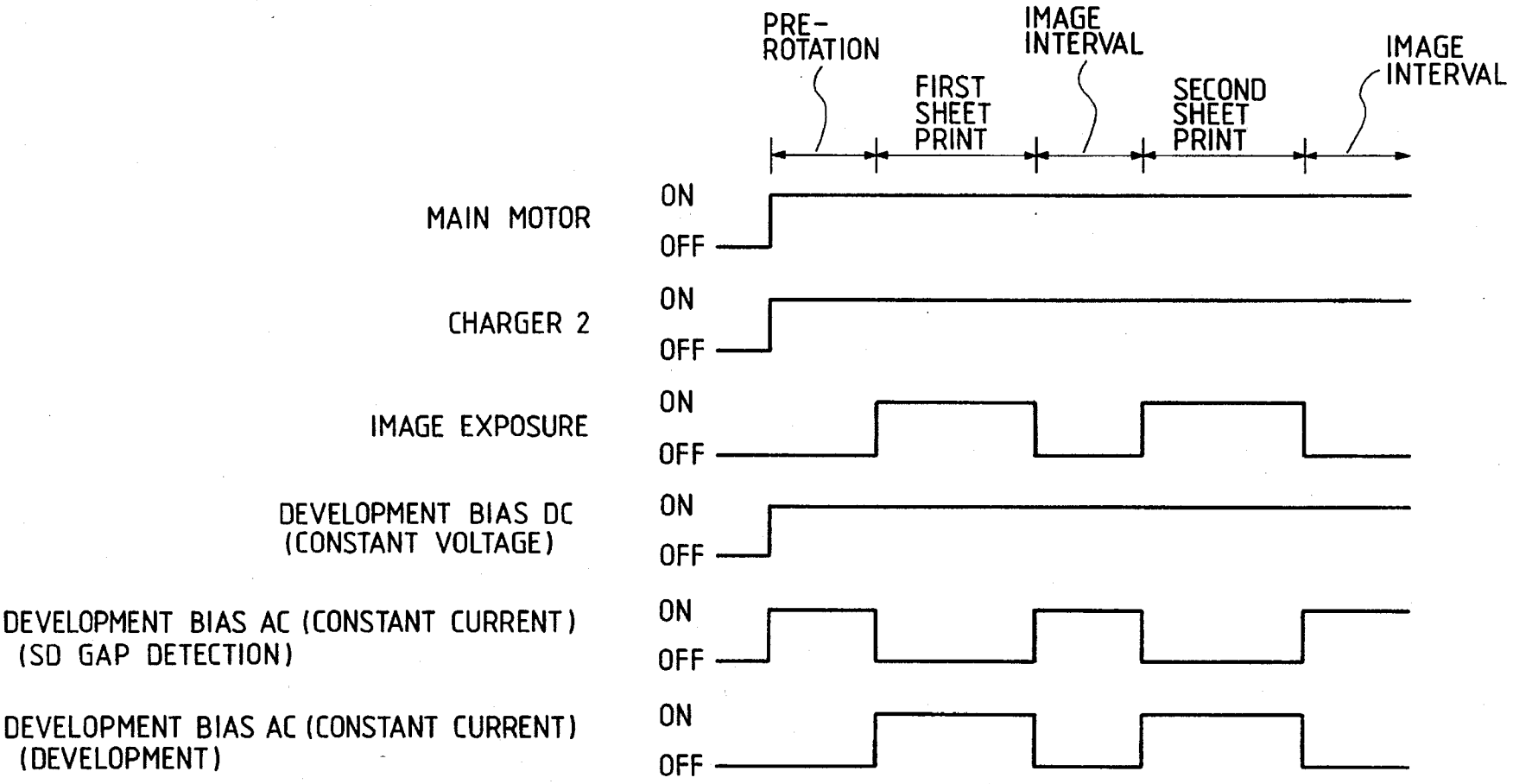
FIG. 6 is a timing chart for explaining the operation sequence of embodiments 1 and 2.

FIG. 5 shows a controller 118 of embodiment 1, and FIG. 6 shows its control sequence.

Simultaneously with the start of pre-rotation of the photosensitive drum 1 by turning on a main motor, the photosensitive drum 1 begins to be charged by the charger 2 (FIG. 1), and the surface of the photosensitive drum 1 is charged to a dark portion potential of −700 V. At this time, a CPU 109 controls a switch circuit 111 to connect a constant current control circuit 104 to an AC power source 101. The constant current control circuit 104 maintains the AC current value of the output from the AC power source 101 to be a target value, e.g., 2 mA (effective value) while receiving the output AC current value of the AC power source 101, which value is detected by and fed back from a current detection circuit 103.

Then, an AC voltage value $V_{D0}$ output from the AC power source 101 at that time is detected by a voltage detection circuit 105. As can be seen from FIG. 4, the detected AC voltage value $V_{D0}$ corresponds to the SD gap. The detected AC voltage value $V_{D0}$ is maintained by a hold circuit 110 via an A/D converter 107 and the CPU 109. (Note that since the AC voltage value $V_{D0}$ corresponds to the SD gap size, detection of the AC voltage value $V_{D0}$ is equivalent to detection of the SD gap size.) Note that the above-mentioned operation is performed in an image interval period.

Then, a laser beam which is modulated according to an image signal is radiated onto the charging surface of the photosensitive drum 1, thus forming an electrostatic latent image on the surface of the photosensitive drum 1. Before the latent image reaches the development region 13 upon rotation of the photosensitive drum 1, the CPU 109 controls the switch circuit 111 to disconnect the AC power source 101 from the constant current control circuit 104, and to connect the AC power source 101 to a constant voltage control circuit 106.

The constant voltage control circuit 106 is applied with the detected voltage $V_{D0}$, which is held in the hold circuit 110 in the pre-rotation of the drum 1, as a target voltage value via a D/A converter 108. The constant voltage control circuit 106 receives the output AC voltage value of the AC power source 101, which is detected by and fed back from the voltage detection circuit 105. Thus, the constant voltage control circuit 106 maintains the output AC voltage value of the AC power source upon development of a latent image, in other words, upon printing, to be the target voltage value $V_{D0}$.

Therefore, when the latent image is developed, the sleeve 6 is applied with a periodic bias voltage obtained by superposing a constant-voltage controlled DC voltage (e.g., −500 V) as an output from a constant voltage DC power source 102 on the target voltage value, i.e., the constant-voltage controlled AC voltage, thus satisfactorily reversal-developing the latent image (the dark portion potential is, e.g., −700 V, and the light portion potential is, e.g., −100 V). More specifically, even when the SD gap changes, a change in strength of the vibration electric field can be prevented. (Note that the constant voltage DC power source 102 is energized not only in the pre-rotation period but also in the image interval period, and the sleeve is applied with a voltage obtained by superposing the output from the DC power source 102 on the output from the AC power source 101 not only during development but also in these periods.)

As described above, in this embodiment, since the AC constant current value is set to be 2 mA and the AC frequency is set to be 1.8 kHz, AC voltage values $V_{pp}$ corresponding to SD gap values are as shown in the graph in FIG. 4.

Therefore, if the SD gap is 300 μm in the apparatus for reverse-developing a latent image (a dark portion potential=−700 V and a light portion potential=−100 V) using a negatively charged toner at a process speed of 47.1 mm/s, the detected voltage (peak-to-peak voltage) $V_{D0}$ is 1,600 V. Therefore, the latent image is developed by the sleeve 6 applied with a periodic bias voltage obtained by superposing a DC voltage, which is constant-voltage controlled to −500 V, on an AC voltage (frequency=1.8 kHz), which is constant-voltage controlled to have a peak-to-peak voltage $V_{pp}$=1,600 V.

In this embodiment, the SD gap is changed within a range of from 250 to 350 μm for the sake of simplicity. However, the effect of this embodiment can be similarly obtained even when the SD gap falls within a range of from 50 to 500 μm, and since the electric field strength upon development can be maintained constant independently of the SD gap, the line width and density are substantially constant. Also, it is confirmed that the same effect as in this embodiment can be attained even when the AC frequency falls within a range of from 600 to 2,400 Hz.

Figure 7:
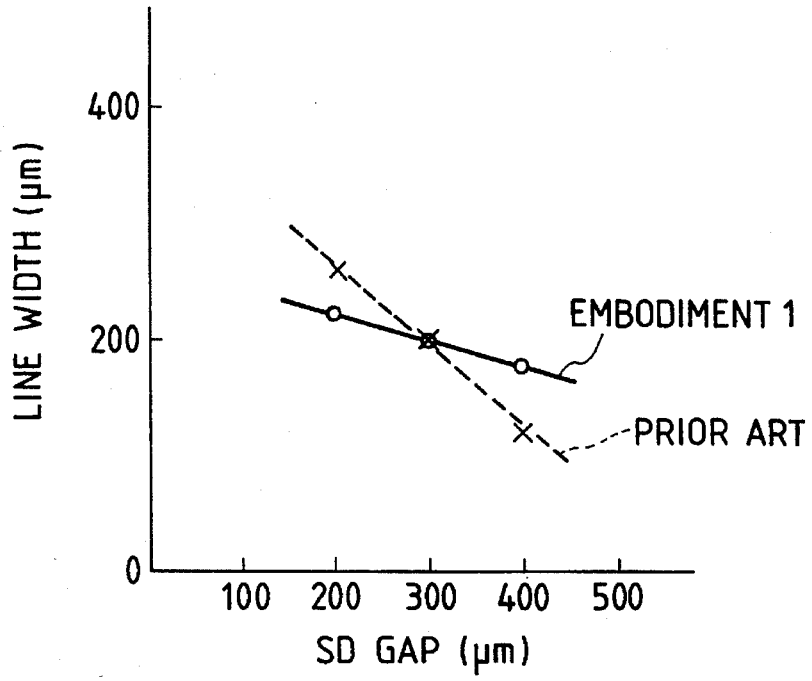
FIG. 7 is a graph for explaining the effect of embodiment 1.
Figure 8:
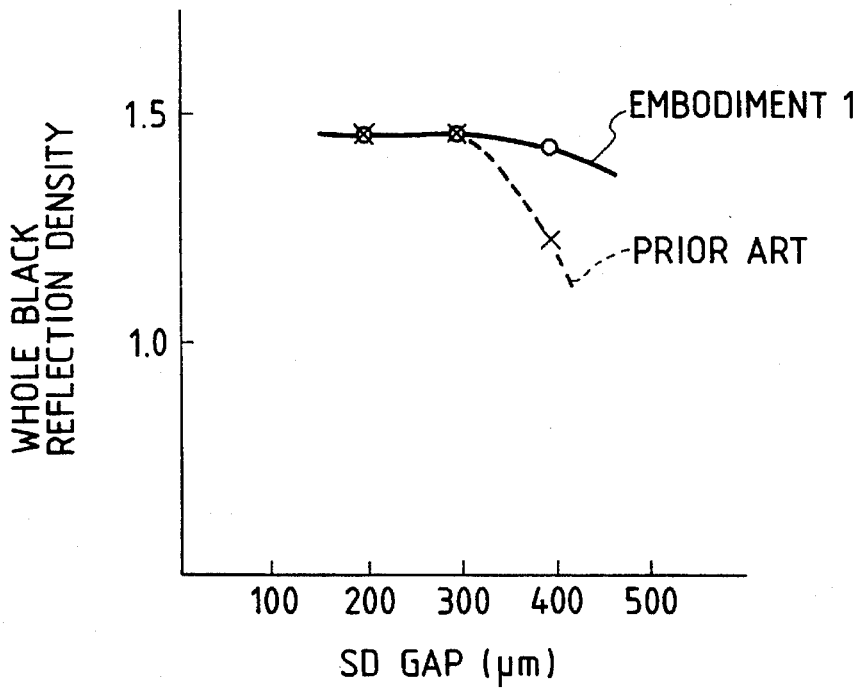
FIG. 8 is a graph for explaining another effect of embodiment 1.

In the prior art, when the SD gap is changed within a range of from 250 to 350 μm, a variation in line width and a change in density occur. This state is shown in the graphs of FIGS. 7 and 8.

Note that the "pre-rotation period" means a period in which the photosensitive drum 1 is rotated, and the chargers and the development device are operated to stabilize the sensitivity of the photosensitive drum, and the operations of the chargers and the development device, after a print switch is turned on until formation of a latent image on the photosensitive drum 1 is started.

The "image interval period" means a period from the end of development of one latent image to the beginning of development of the next latent image when a plurality of latent images are continuously formed, i.e., when print operations are continuously performed on a plurality of paper sheets.

During the pre-rotation period and the image interval period, since the development sleeve 6 opposes a region where no latent image is formed, i.e., a non-image region of the photosensitive drum 1, a toner is not practically consumed by the drum 1 even when the bias voltage is applied to the sleeve 6 during these periods.

(Embodiment 2)

In embodiment 2, a target AC voltage value $V_{DT}$ is calculated by the CPU 109 on the basis of the AC voltage value $V_{D0}$ which is detected while the non-image region of the photosensitive drum 1 is passing the development region.

More specifically, the CPU 109 substitutes the detected AC voltage value $V_{D0}$ in a predetermined function $V_{DT}=f(V_{D0})$ to calculate the target AC voltage value $V_{DT}$ corresponding to the detected value $V_{D0}$. This target value $V_{DT}$ is maintained by the hold circuit 110.

When an image region of the photosensitive drum 1 passes the development region 13, the CPU 109 supplies the AC voltage value $V_{DT}$ maintained in the hold circuit 110 as a target AC voltage value to the constant voltage control circuit 106 via the D/A converter. The control circuit 106 maintains the voltage value of an AC voltage to be applied to the sleeve 6 to be the above-mentioned voltage value $V_{DT}$.

Other arrangements are the same as those in embodiment 1.

Figure 9:
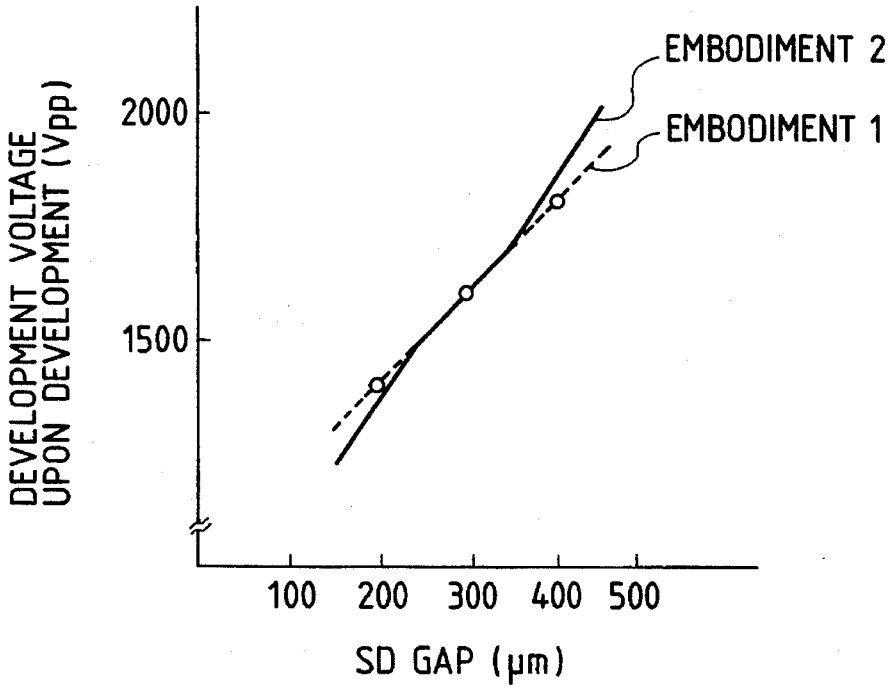
FIG. 9 is a graph for explaining the relationship between the AC voltage and the SD gap in embodiment 2.

FIG. 9 shows the relationship between the SD gap and the AC voltage upon development. A dotted line represents the case of embodiment 1, and a solid line represents the case of embodiment 2.

As can be understood from these lines, a linear function is adopted as the above-mentioned function in this embodiment.

If the function f of this embodiment is given by:

$$V_{DT}=f(V_{D0})=\alpha V_{D0}+\beta$$

then when $250\ \mu m \leqq SD \leqq 350$, $\alpha=1$ when $SD \leqq 250$, $350 \leqq SD$, $\alpha=1.5$ where $\beta$ is a constant determined depending on the cases. More specifically, when the SD gap is equal to or larger than 250 μm and is equal to or smaller than 350 μm, the same control as in embodiment 1 is performed. However, when the SD gap is equal to or smaller than 250 μm or is equal to or larger than 350 μm, the inclination $\alpha=1.5$ is set, and the effect of this embodiment is superior to that of embodiment 1, as shown in FIGS. 10 and 11.

Figure 10:
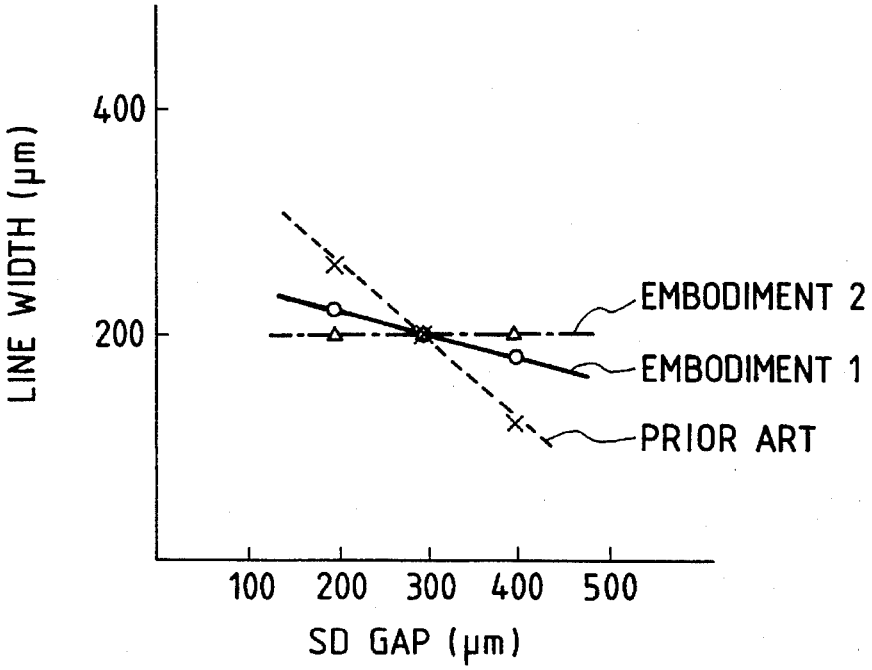
FIG. 10 is a graph for explaining the effect of embodiment 2.
Figure 11:
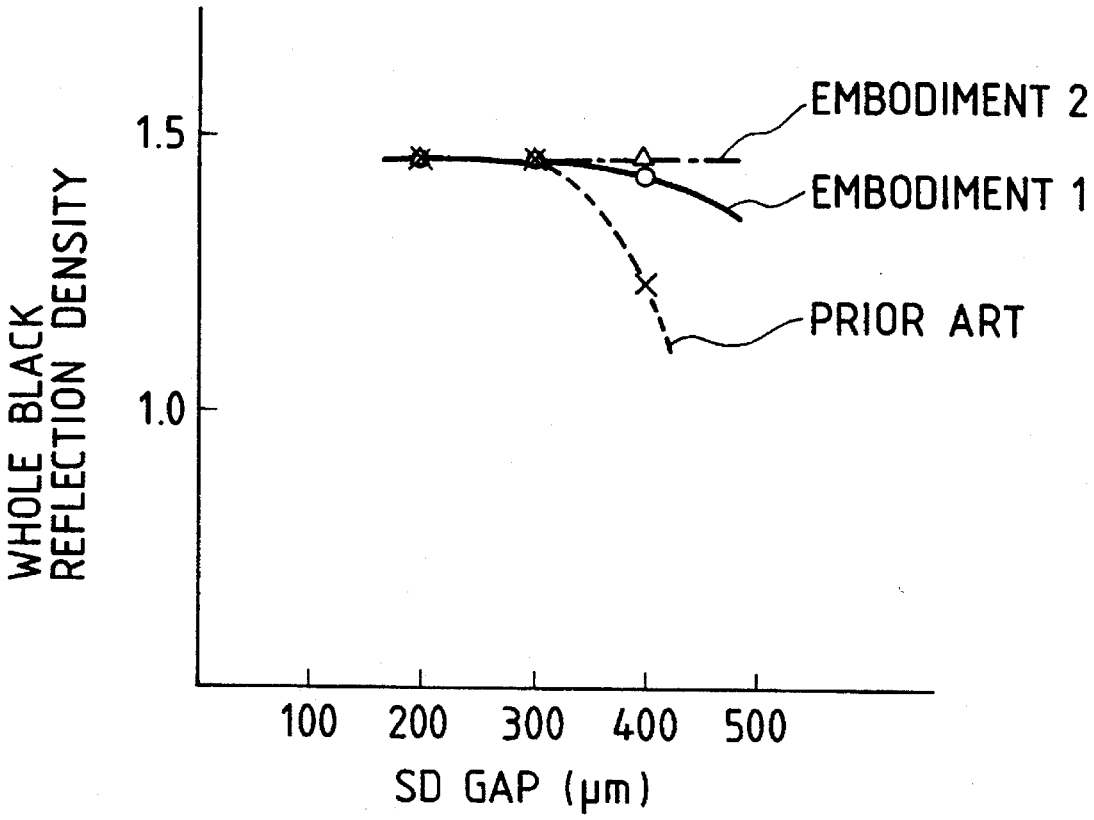
FIG. 11 is a graph for explaining another effect of embodiment 2.

More specifically, as shown in FIG. 10, according to this embodiment, the line width can be controlled to be further constant. That is, this effect is obtained since the AC electric field is set to be relatively stronger than that in embodiment 1 when the SD gap is equal to or larger than 350 μm, and the AC electric field is set to be relatively weaker than that in embodiment 1 when the SD gap is equal to or smaller than 250 μm. FIG. 11 shows the relationship between the SD gap and the whole black density. In this embodiment, a decrease in density when the SD gap is equal to or larger than 350 μm can be effectively prevented.

As described above, when an AC voltage upon development is determined by substituting a detected voltage in a predetermined function, a stable image can be obtained within a wider range of the SD gap.

Note that the above-mentioned values of $\alpha$ and $\beta$ are merely examples used for the sake of descriptive convenience of the present invention, and the present invention is not limited to the above-mentioned values. Also, in this embodiment, a linear equation is used as the equation of $f(V_{D0})$. However, equations other than a linear equation can be used according to the gist of this embodiment, as a matter of course.

(Embodiment 3)

Figure 12:
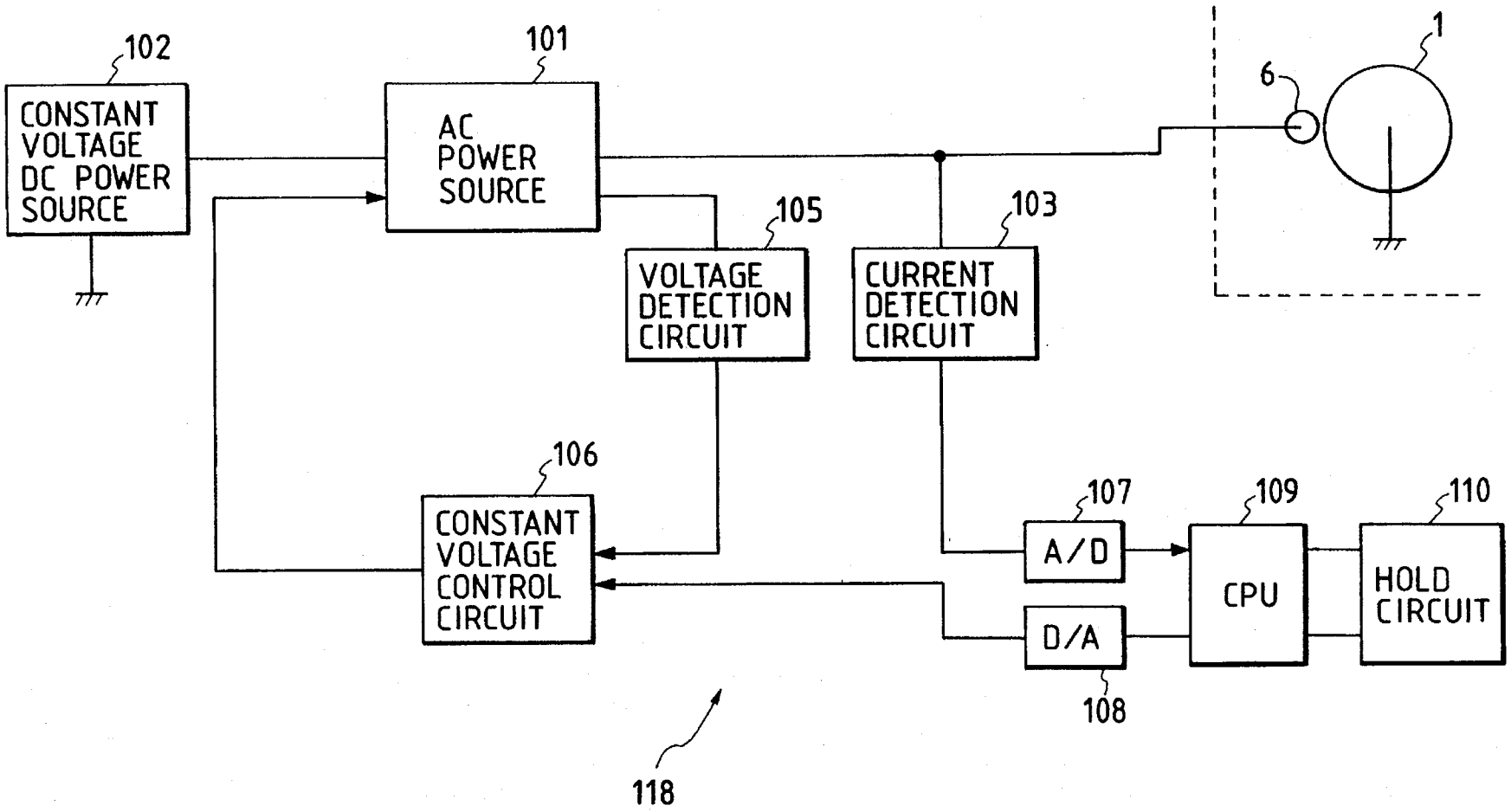
FIG. 12 is a block diagram for explaining a controller of embodiment 3.

FIG. 12 shows the controller 118 of embodiment 3.

In pre-rotation and in image interval, the CPU 109 controls the constant voltage control circuit 106, so that the output from the AC power source 101 is maintained to be a predetermined constant voltage value $V_R$. An AC current value $i_0$ at this time is detected by the current detection circuit 103, and the detected value $i_0$ is supplied to the CPU 109 via the A/D converter 107.

The CPU 109 substitutes the detected value $i_0$ in a predetermined function $V_{DT}=f(i_0)$ to calculate an AC voltage value $V_{DT}$ corresponding to the detected value $i_0$. This value $V_{DT}$ is maintained in the hold circuit 110. Upon development, the CPU 109 applies the AC voltage value $V_{DT}$ as a target AC voltage value to the constant voltage control circuit 106 via the D/A converter 108.

Thus, the output AC voltage from the AC power source upon development is maintained to be the voltage value $V_{DT}$.

In this embodiment, the output from the AC power source 101 is constant-voltage controlled to have $V_R$ (peak-to-peak voltage)=800 V, and the AC current $i_0$ at that time is detected. According to FIG. 3, since the SD gap size is uniquely determined by the value $i_0$, the function $V_{DT}=f(i_0)$ is determined, so that the AC voltage upon development is represented by the line of embodiment 2 or the line of embodiment 1 shown in FIG. 9 in correspondence with the SD gap size at that time. Thus, the same effect as in embodiment 2 or 1 shown in FIGS. 10 and 11 can be obtained in this embodiment.

It is conventionally known that a leak phenomenon occurs when an AC voltage beyond a voltage according to the Paschen's law is applied in correspondence with the SD gap. If this leak phenomenon occurs slightly, white dots are formed when a whole black image is printed; if this phenomenon occurs considerably, an elliptic leakage mark is formed.

According to the present invention, since the AC voltage value changes in accordance with the SD gap, it is almost certain that no leak phenomenon occurs. However, since the leak phenomenon may occur in constant current control although such cases are very rare, the leak phenomenon can be prevented more satisfactorily by limiting the maximum value of the AC voltage. Therefore, it is preferable to arrange a limiter so that the AC voltage does not exceed a voltage as a sum of the value $V_{PP}$ corresponding to the SD gap and 200 V even instantaneously in the graph in FIG. 4. Thus, perfect leak prevention can be realized. However, when a current is detected using a constant-voltage controlled AC voltage, a voltage at which leak prevention can be attained need only be selected, and no limiter is required.

(Embodiment 4)

Figure 13:
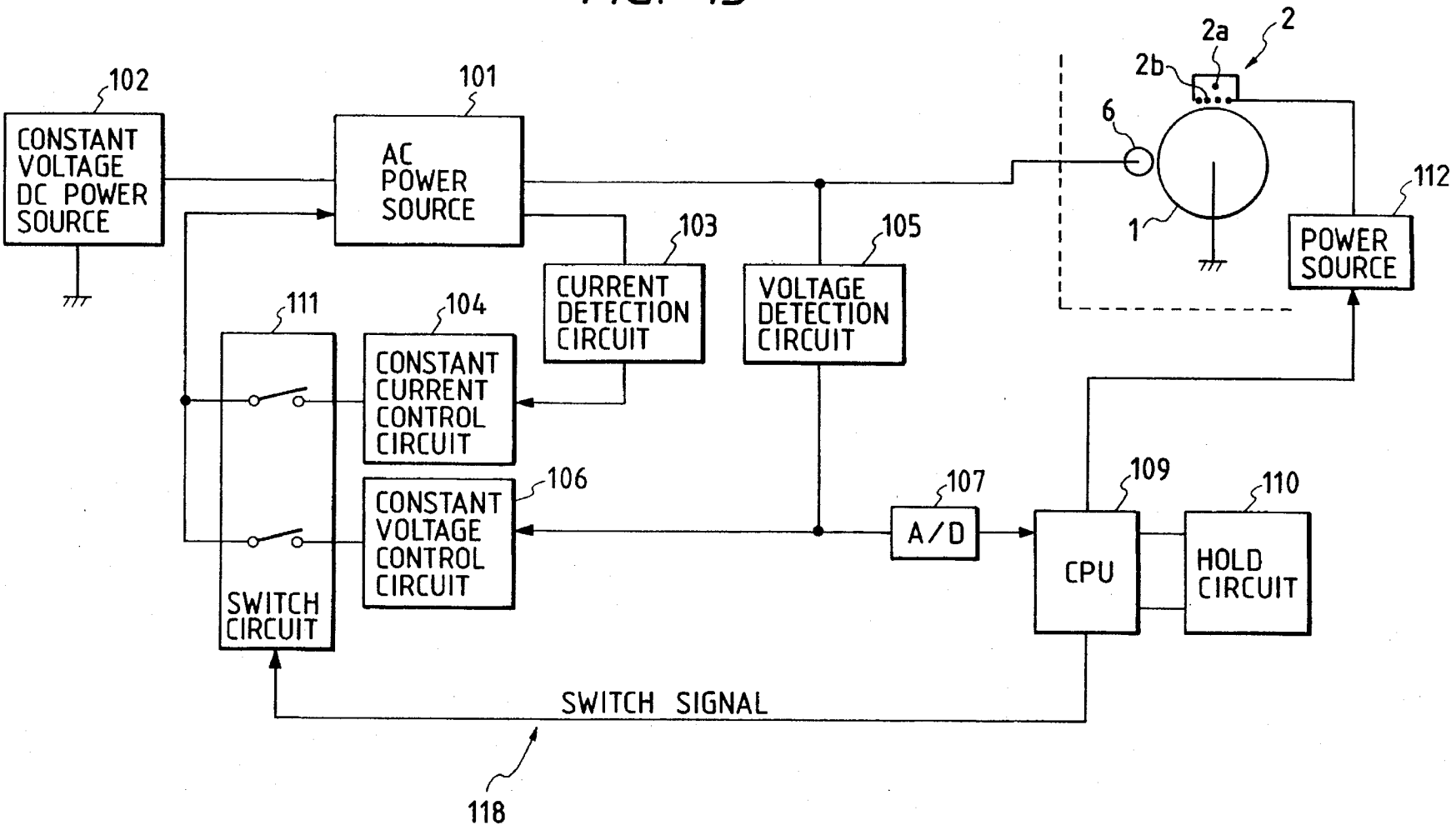
FIG. 13 is a block diagram for explaining a controller of embodiment 4.
Figure 14:
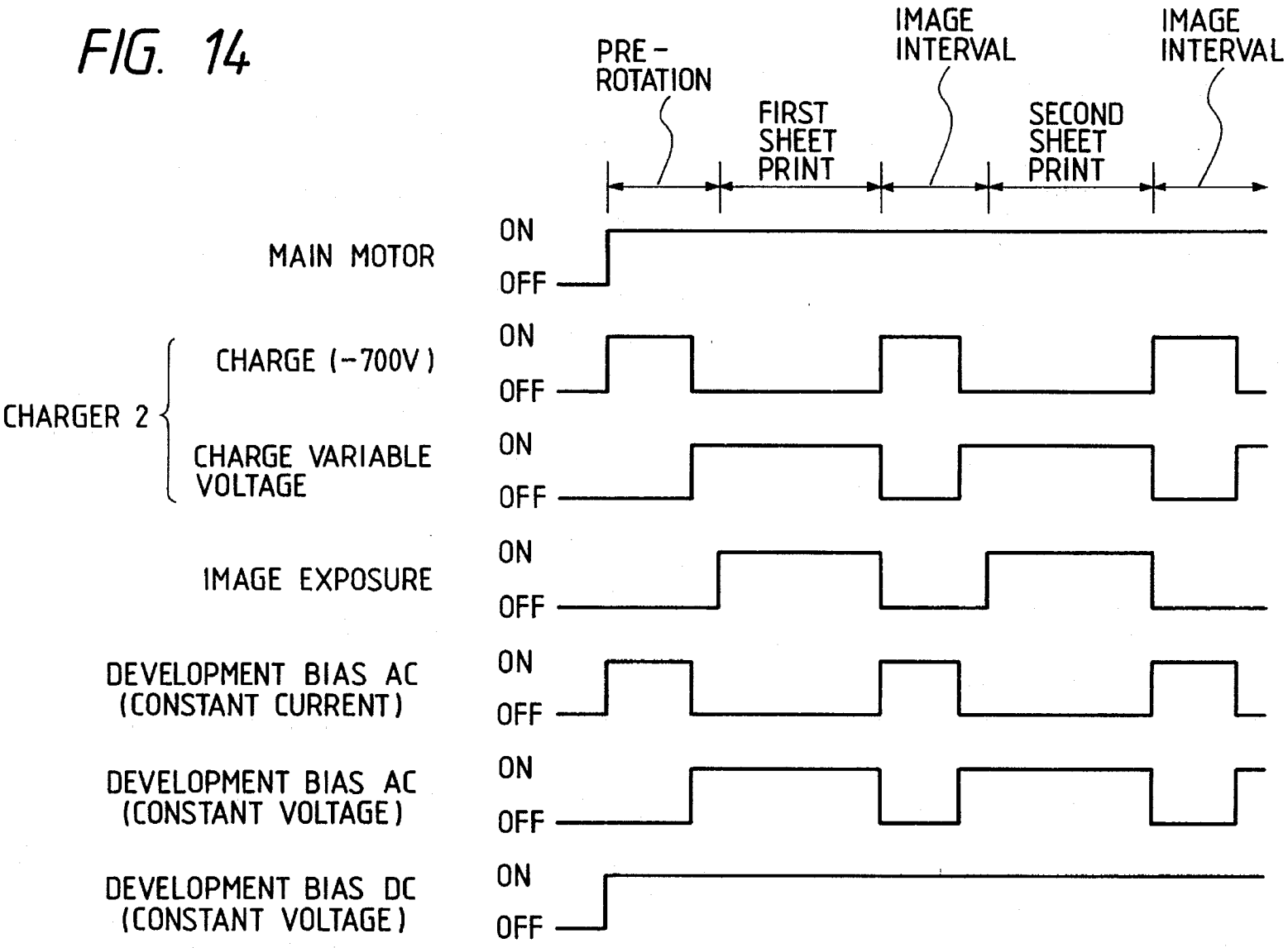
FIG. 14 is a timing chart for explaining the operation sequence of embodiment 4.

FIG. 13 shows the controller 118 of embodiment 4, and FIG. 14 shows its operation sequence.

In this embodiment, in pre-rotation and in image interval, the CPU 109 controls a variable power source 112 to apply a reference voltage (e.g., −700 V) to a grid 2b of the charger 2. (A corona discharger 2a is applied with, e.g., −5 kV.) As is well known, the surface potential (dark portion potential $V_D$) of the photosensitive body 1 substantially equals the voltage applied to the grid 2b.

On the other hand, the CPU 109 connects the constant current control circuit 104 to the AC power source 101 via the switch circuit 111. Thus, the output from the AC power source 101 is constant-current controlled to, e.g., 2 mA (effective value).

An AC voltage value $V_{D0}$ of the output from the AC power source 101 at that time is detected by the voltage detection circuit 105, and the CPU 109 determines a target surface potential $V_{DP}$ corresponding to the detected voltage value $V_{D0}$, i.e., a voltage value $V_{DP}$ to be applied to the grid 2b. The voltage value $V_{DP}$ is maintained in the hold circuit 110.

Upon development, the CPU 109 sets the output voltage of the power source 112 to be the above-mentioned voltage value $V_{DP}$. Thus, the surface potential (dark portion potential) of the photosensitive drum 1 is set to be $V_{DP}$.

On the other hand, the CPU 109 connects the AC power source 101 to the constant voltage control circuit 106 via the switch circuit 111. Thus, the output from the AC power source 101 is constant-voltage controlled to a predetermined voltage, e.g., 1,700 V (peak-to-peak voltage).

Note that the output from the AC power source 101 is a rectangular wave having a frequency of, e.g., 1.8 kHz. Like in the above embodiments, a DC voltage (e.g.. −500 V) output from the DC power source 102 is superposed on the AC voltage output from this AC power source 101. Note that the detected AC voltage value $V_{D0}$ corresponds to the SD gap size, as shown in FIG. 4.

Figure 15:
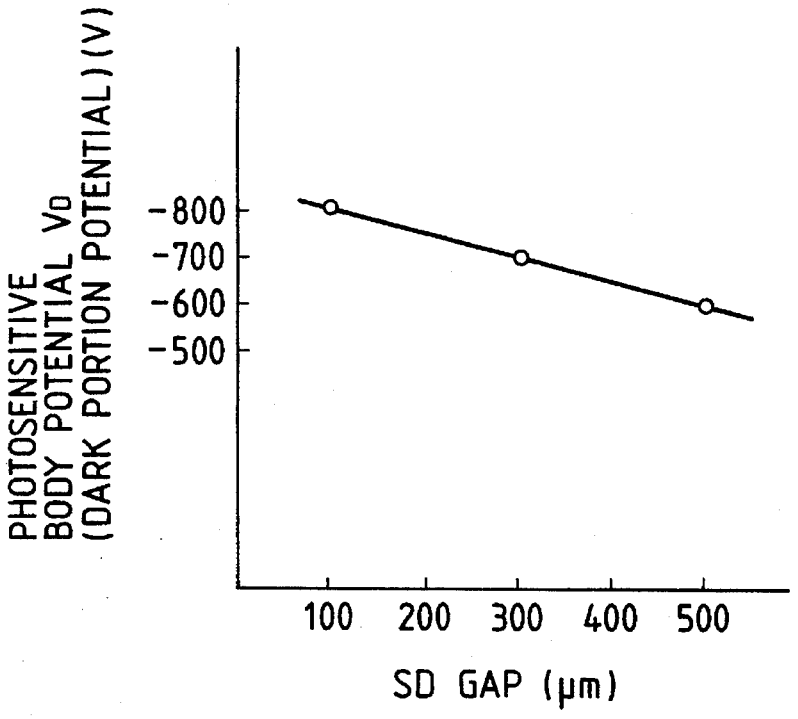
FIG. 15 is a graph for explaining the relationship between the SD gap and the photosensitive body potential in embodiment 4.

In order to prevent a variation in electric field strength upon using the constant-voltage controlled AC voltage, the photosensitive body surface potential $V_D$ and the SD gap must have the relationship shown in FIG. 15 therebetween. Therefore, the photosensitive body surface potential corresponding to the SD gap, i.e., the voltage $V_{DP}$ to be applied to the grid 2b can be obtained from the detected AC voltage $V_{D0}$ on the basis of FIGS. 4 and 15.

In this manner, if the SD gap is 300 μm upon development of a latent image on the photosensitive drum 1 using a negatively charged toner at a process speed of 47.1 μm/s, a high-quality image can be output on the image region under the following condition:

Photosensitive drum charging potential:

−700 V (dark portion potential)

(a value determined by the detected voltage when SD gap −300 μm)

Development bias:

| | |
|---|---|
| AC voltage(constant voltage) | 1,700 V(peak-to-peak value) |
| frequency | 1.8 kHz |
| DC voltage | −500 V |

In this embodiment, the AC voltage upon development is maintained as a single constant voltage independent of the SD gap.

In this embodiment, for example, when the SD gap is 100 μm, $V_D$=−800 V; when the SD gap is 300 μm, $V_D$=−700 V; and when the SD gap is 500 μm, $V_D$=−600 V, thereby maintaining a substantially constant line width and density.

Figure 16:
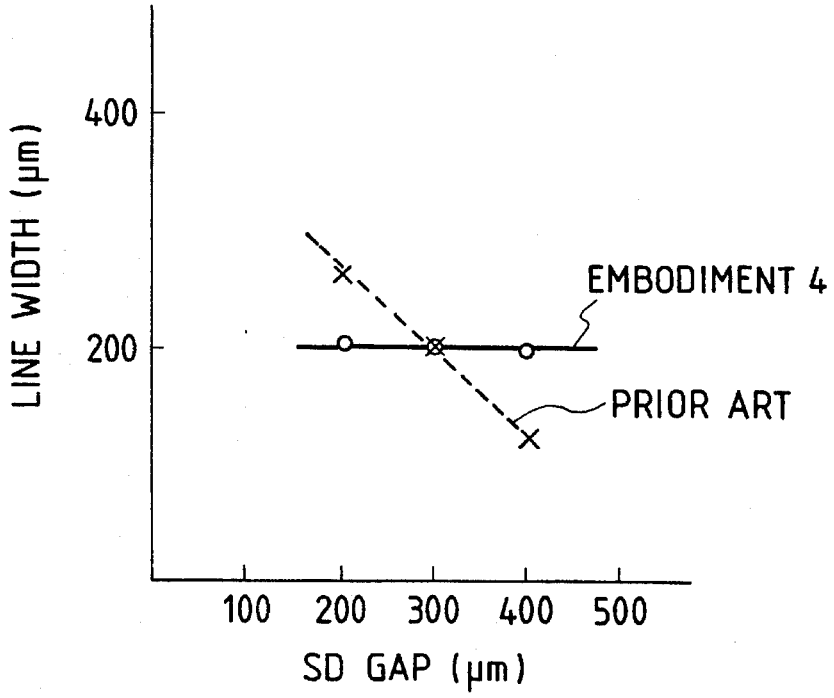
FIG. 16 is a graph for explaining the effect of embodiment 4.
Figure 17:
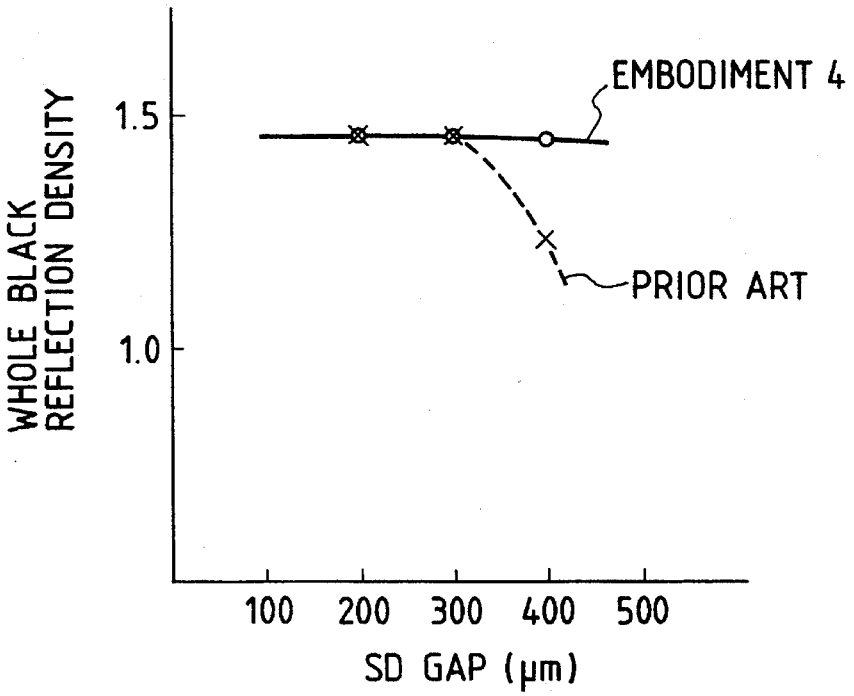
FIG. 17 is a graph for explaining another effect of embodiment 4.

In the prior art, when the SD gap is changed within a range of from 250 to 350 μm, a variation in line width and a change in density occur. This state is shown in the graphs of FIGS. 16 and 17.

(Embodiment 5)

In this embodiment, the output voltage from the DC power source 102 is controlled on the basis of the detected AC voltage value $V_{D0}$ in place of the dark portion potential of the photosensitive body 1 described in embodiment 4. Therefore, the dark portion potential of the photosensitive body 1 is maintained constant (e.g., −700 V) independently of the SD gap size, while the DC voltage component of the vibration bias voltage to be applied to the sleeve 6 upon development of a latent image, i.e., the value of the output voltage from the DC power source 102, is changed in accordance with the SD gap size. Other control operations are the same as those in embodiment 4.

Figure 18:
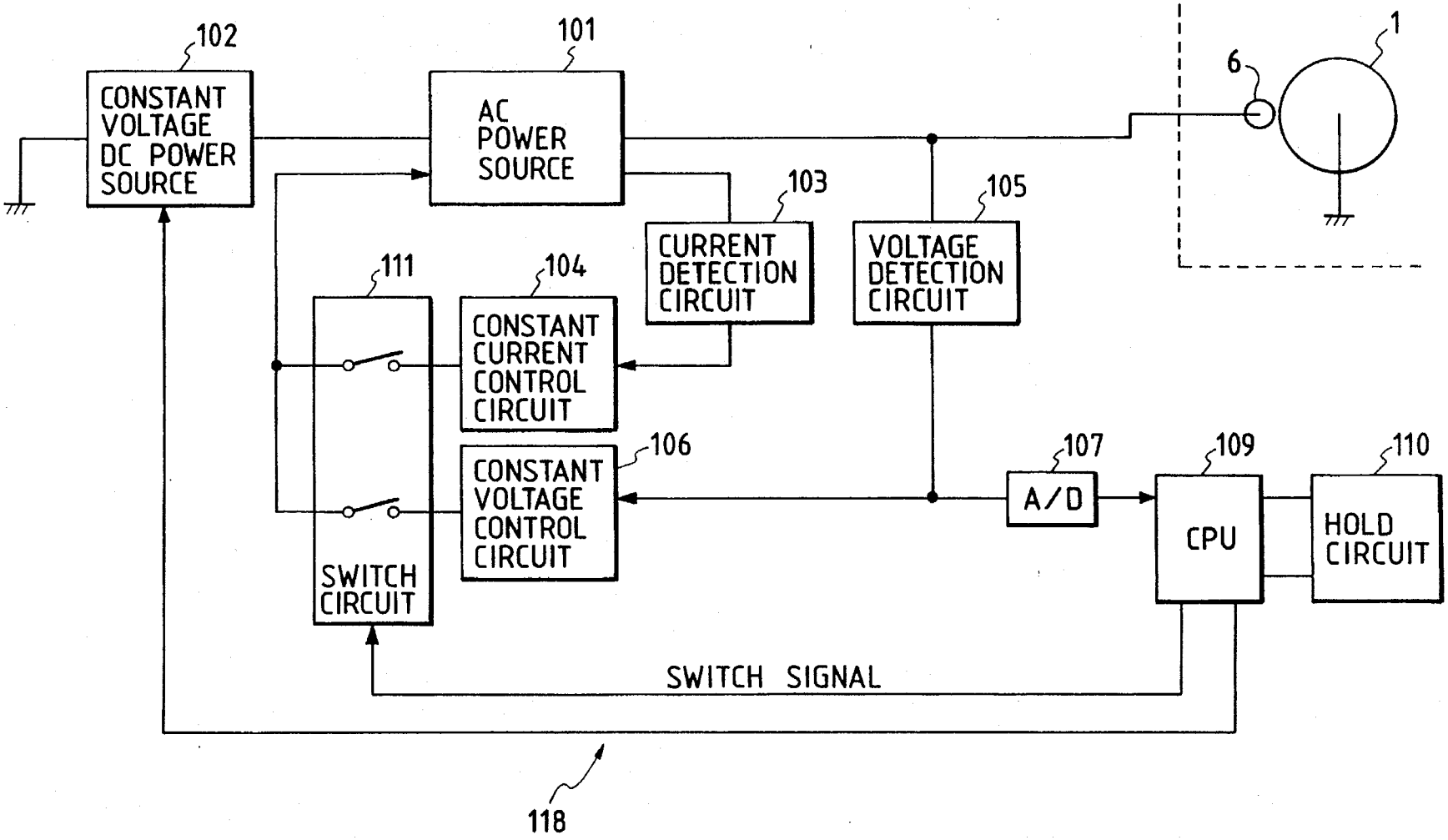
FIG. 18 is a block diagram for explaining a controller of embodiment 5.

FIG. 18 shows the controller 118 of this embodiment.

In pre-rotation and in image interval, the CPU 109 controls the DC power source 102 to output a DC voltage having a constant value (e.g., −500 V) independently of the SD gap size.

On the other hand, the CPU 109 determines a DC voltage value $V_{DC}$ upon development on the basis of the detected AC voltage value $V_{D0}$, and causes the hold circuit 110 to maintain this value $V_{DC}$. The CPU 109 maintains the output voltage of the DC power source 102 upon development to be the value $V_{DC}$.

Figure 19:
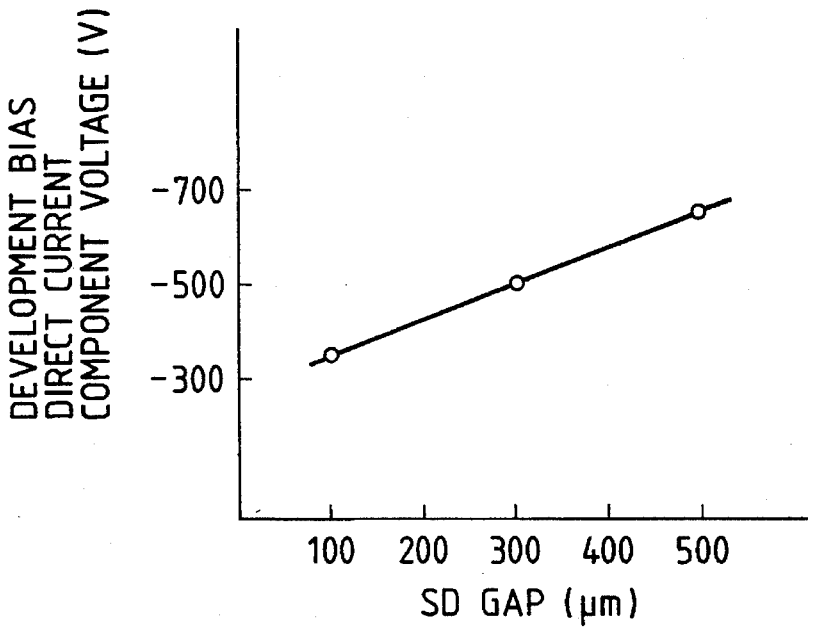
FIG. 19 is a graph for explaining the relationship between the SD gap and the DC voltage in embodiment 5.

The graph in FIG. 19 shows the relationship between the SD gap size and the development bias DC component $V_{DC}$ in this embodiment.

In embodiment 5, since $V_D$ is constant, $V_L$ (light portion potential) is also constant. For this reason, the line width and density correspond to the development bias DC voltage. When this voltage is low (−350 to −500 V), a contrast from $V_L$ is small, and as a result, a small line width and a relatively low density are obtained. When this DC voltage is high (−650 to −500 V), a contrast from $V_L$ is large, and a large line width and a high density are obtained. Therefore, in embodiment 5, when the SD gap is small (100 μm), $V_{DC}$=−350 V is set; when the SD gap has a middle value (300 μm), $V_{DC}$=−500 V is set; and when the SD gap is large (500 μm), $V_{DC}$=−650 V is set.

In embodiment 5 as well, the same effect as in embodiment 4 described above can be achieved, and the results shown in FIGS. 16 and 17 directly apply to this embodiment.

(Embodiment 6)

In embodiment 4, the dark portion potential $V_D$ is controlled in accordance with the SD gap size, and in embodiment 5, the DC voltage component $V_{DC}$ is controlled in accordance with the SD gap size. In these cases, the difference (contrast) between the DC voltage and the light portion potential $V_L$ of a latent image slightly changes due to a change in the SD gap.

In order to further suppress the change in contrast, it is preferable to combine embodiments 4 and 5.

In this case, the charging voltage of the photosensitive drum 1 is controlled based on the detected AC voltage value $V_{D0}$ to have a value shown in FIG. 15, and at the same time, the voltage value of the development bias DC component is constant-voltage controlled to have a value shown in FIG. 19, thus performing a print operation. For example, when the SD gap is 300 μm, $V_D$=−700 V, and $V_{DC}$=−500 V.

(Embodiment 7)

In embodiment 7, a voltage to be applied to the grid 2b of the charger 2 is controlled using the detected AC current value $i_0$ as in embodiment 3. In other words, the dark portion potential $V_D$ of the photosensitive body is controlled. Upon development, the output from the AC power source 101 is constant-voltage controlled to a predetermined voltage (e.g., a peak-to-peak value of 1,700 V). Other control operations are the same as those in embodiment 3.

Figure 20:
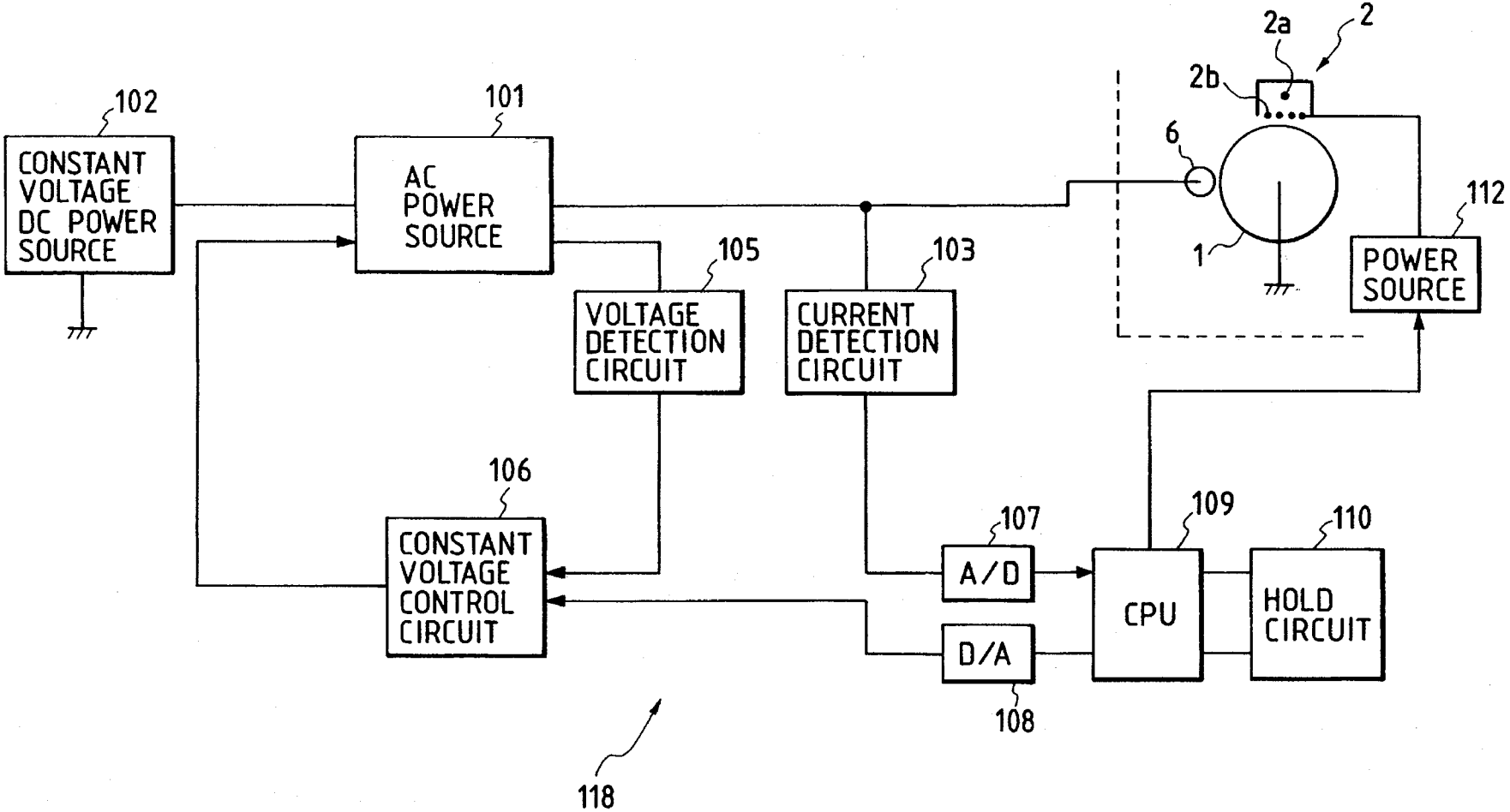
FIG. 20 is a block diagram for explaining a controller of embodiment 7.
Figure 21:
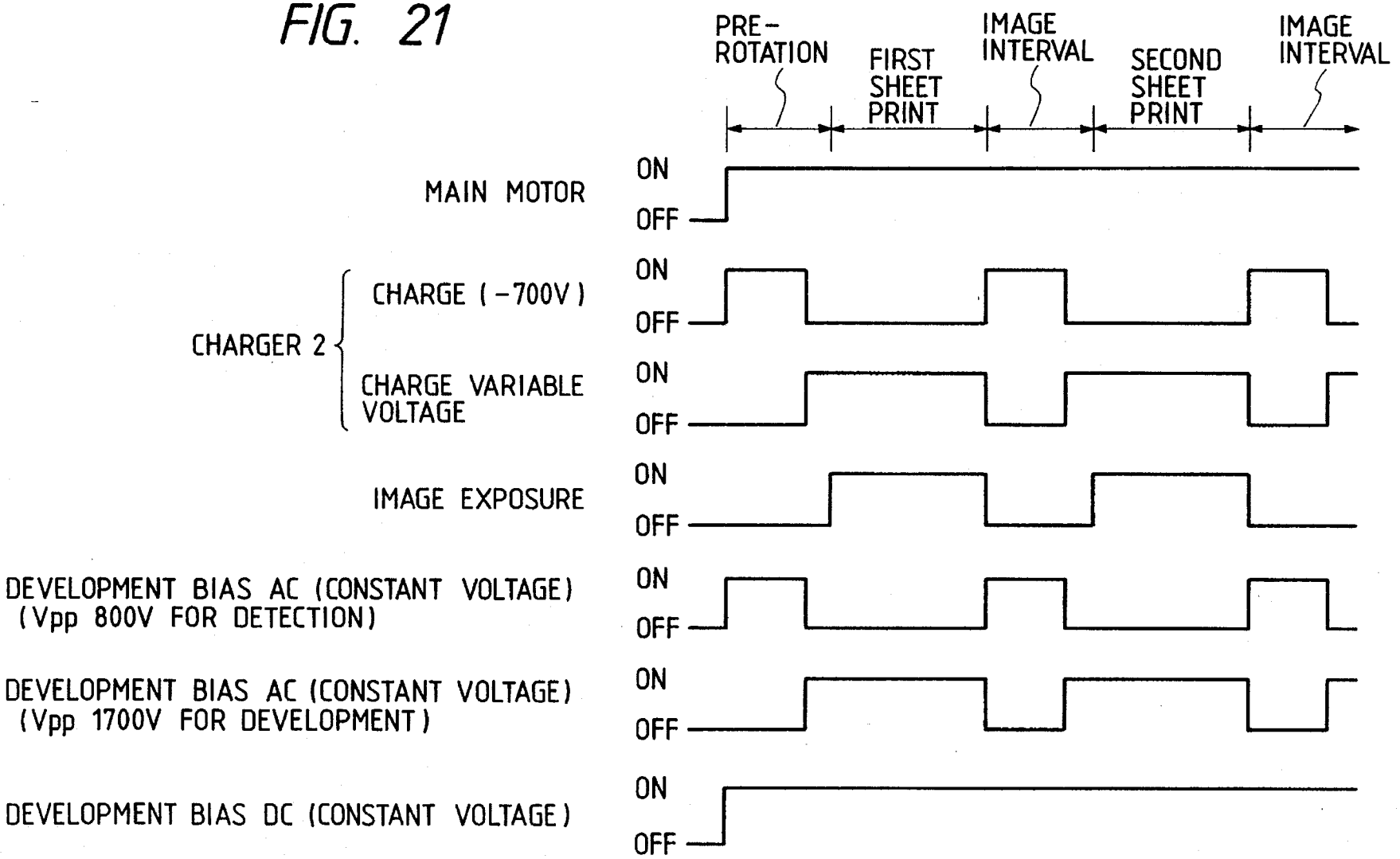
FIG. 21 is a timing chart for explaining the operation sequence of embodiment 7.

FIG. 20 shows the controller 118 of this embodiment, and FIG. 21 shows its operation sequence.

The dark portion potential corresponding to the detected AC current value $i_0$ can be obtained from FIGS. 4 and 17. For example, when the AC voltage upon detection is constant-voltage controlled to a peak-to-peak value of 800 V, if the detected AC current value $i_0$ is 1.1 mA, then the dark portion potential $V_D$ is set to be −700 V. This is because the SD gap is 300 μm.

In this embodiment as well, the effects shown in FIGS. 16 and 17 can be obtained.

(Embodiment 8)

In embodiment 8, the output voltage $V_{DC}$ from the DC power source 102 is controlled using the detected AC current value $i_0$. Other control operations are the same as those in embodiment 7.

The DC voltage value $V_{DC}$ corresponding to the detected AC current value $i_0$ can be obtained from FIGS. 4 and 19.

Figure 22:
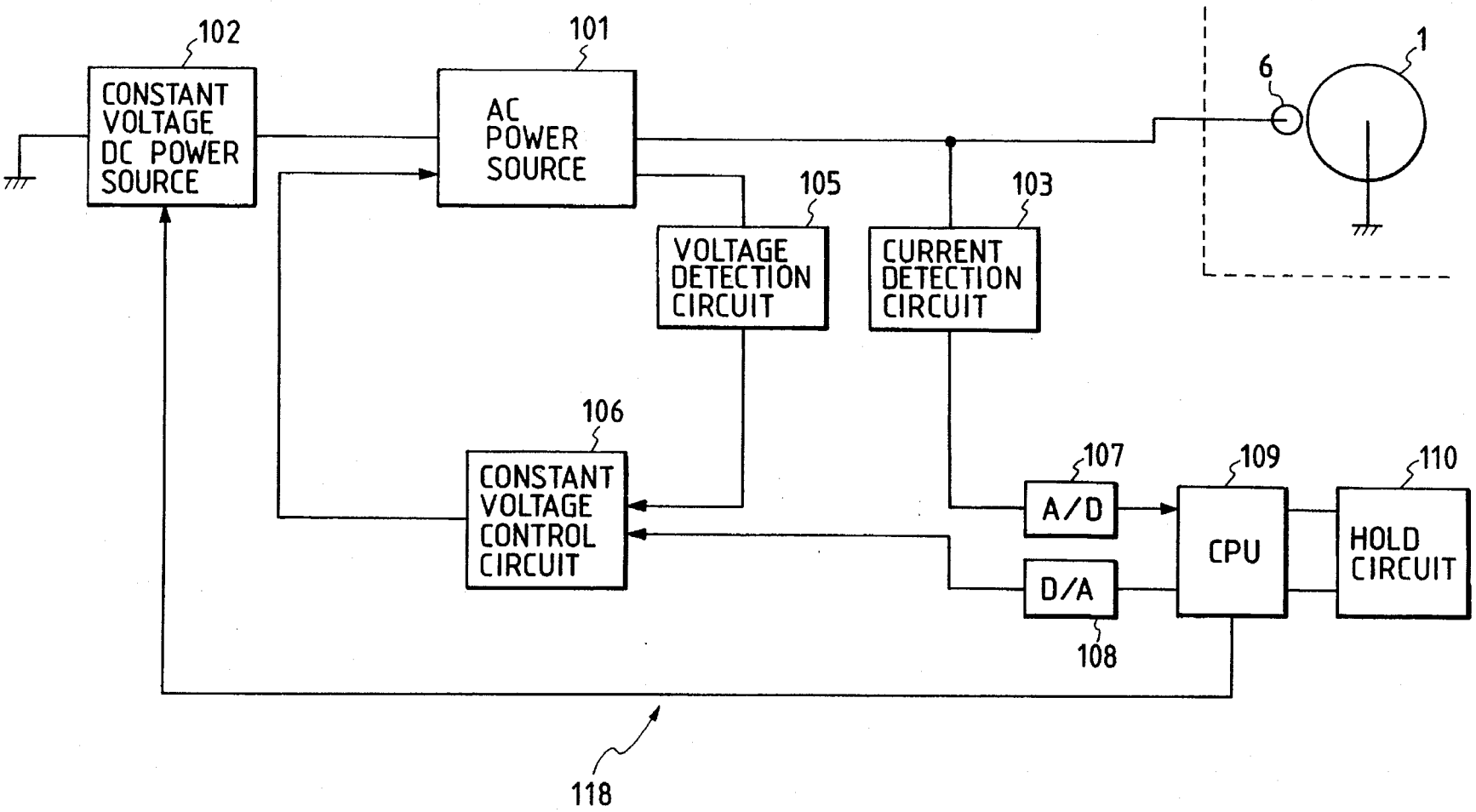
FIG. 22 is a block diagram for explaining a controller of embodiment 8.

FIG. 22 shows the controller 118 of embodiment 8.

In this embodiment as well, the effects shown in FIGS. 16 and 17 can be obtained.

When embodiments 7 and 8 are combined, the effects of prevention of a change in line width and prevention of a change in image density can be enhanced.

(Embodiment 9)

In this embodiment, the light emission intensity of a light source of an exposure optical system, i.e., a semiconductor laser 35*a*, is controlled. In other words, the exposure amount of the photosensitive body 1 is controlled.

More specifically, in pre-rotation and in image interval, the AC power source 101 outputs an AC voltage which is constant-current controlled to a predetermined current (e.g., 2 mA), and an AC voltage value $V_{D0}$ applied to the sleeve 6 at that time is detected. The CPU 109 determines a drive current $I_D$ to be applied to the laser 35*a* on the basis of the detected AC voltage value $V_{D0}$, and causes the hold circuit 110 to maintain this value.

Upon development, the CPU 109 controls a laser driver 113 to apply a drive current having the value $I_D$ to the laser 35*a*. In this embodiment, the dark portion potential of the photosensitive body 1 is set to be constant independently of the SD gap size. Other control operations are the same as those in embodiment 4.

Figure 23:
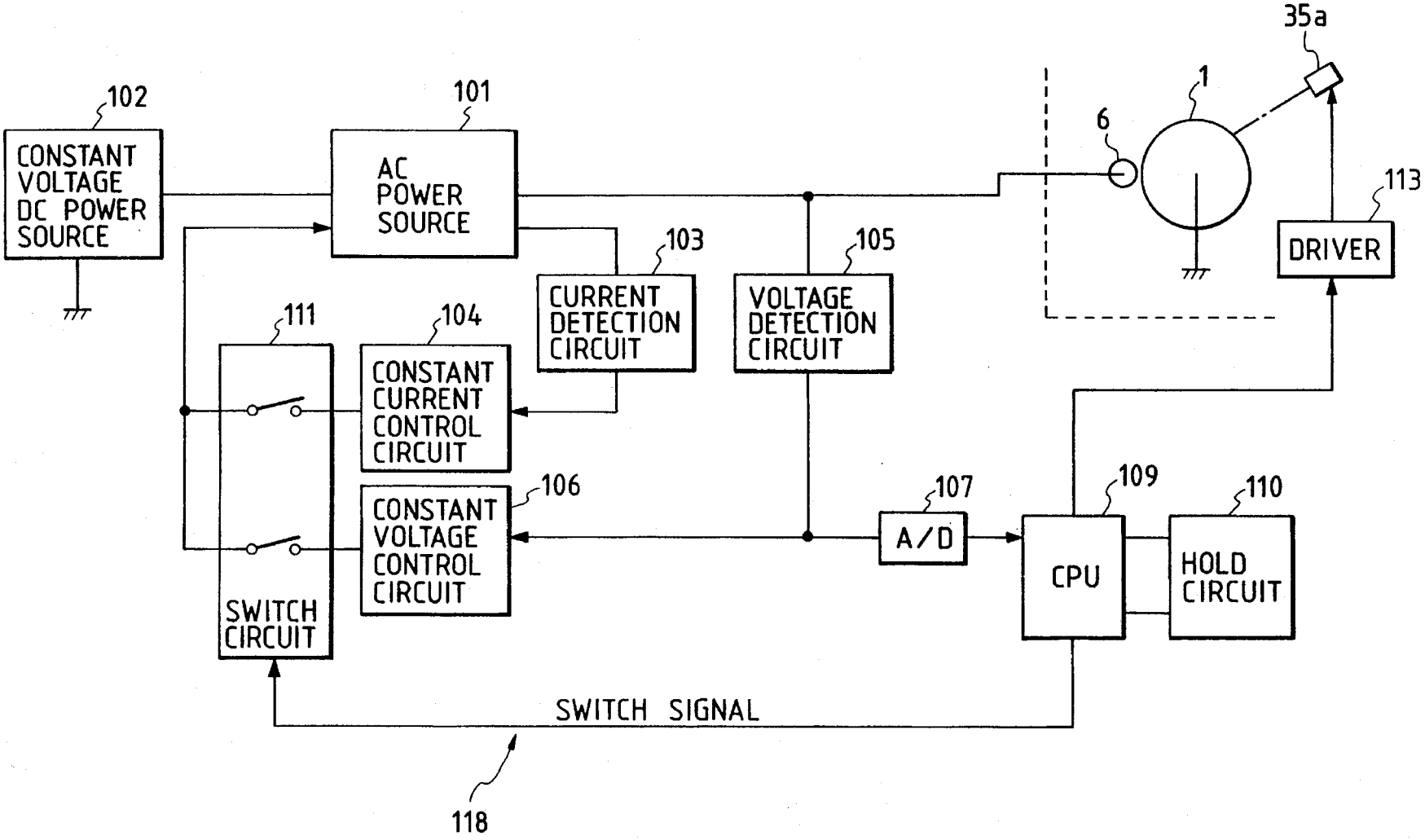
FIG. 23 is a block diagram for explaining a controller of embodiment 9.

FIG. 23 shows the controller 118 of embodiment 9.

Figure 24:
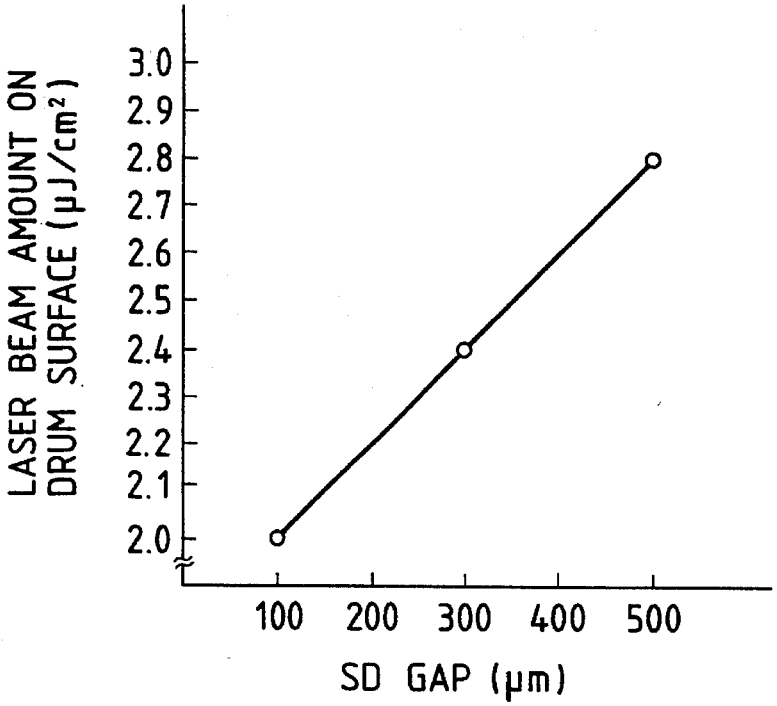
FIG. 24 is a graph for explaining the relationship between the SD gap and the laser beam amount on the drum surface in embodiment 9.

FIG. 4 shows the relationship between the SD gap and the AC voltage, and FIG. 24 shows the relationship between the SD gap and the laser beam intensity. From FIGS. 4 and 24, a laser beam intensity corresponding to each AC voltage, i.e., a laser drive current $I_D$, can be obtained.

Referring to FIG. 24, the laser beam amount on the photosensitive drum surface is 2.4 μJ/cm$^2$ when the SD gap is, e.g., 300 μm. When the SD gap is small (100 to 200 μm), since the line width increases if the laser beam amount remains the same, the laser beam amount on the drum surface is decreased. For example, when the SD gap is 100 μm, the laser beam amount is set to be 2.0 μJ/cm$^2$. In contrast to this, when the SD gap is large (400 to 500 μm), since the line width and density decrease, the laser beam amount is increased. For example, when the SD gap is 500 μm, the laser beam amount is set to be 2.8 μJ/cm$^2$. When the laser beam Mount is increased, the line width and density increase; when the laser beam amount is decreased, the line width and density decrease.

In this embodiment, when the SD gap is small (100 to 200 μm), the laser beam amount is decreased to prevent the line width from increasing. In this case, the laser beam amount is decreased by about 15% of 2.4 μJ/cm$^2$ to prevent a decrease in density.

Figure 25:
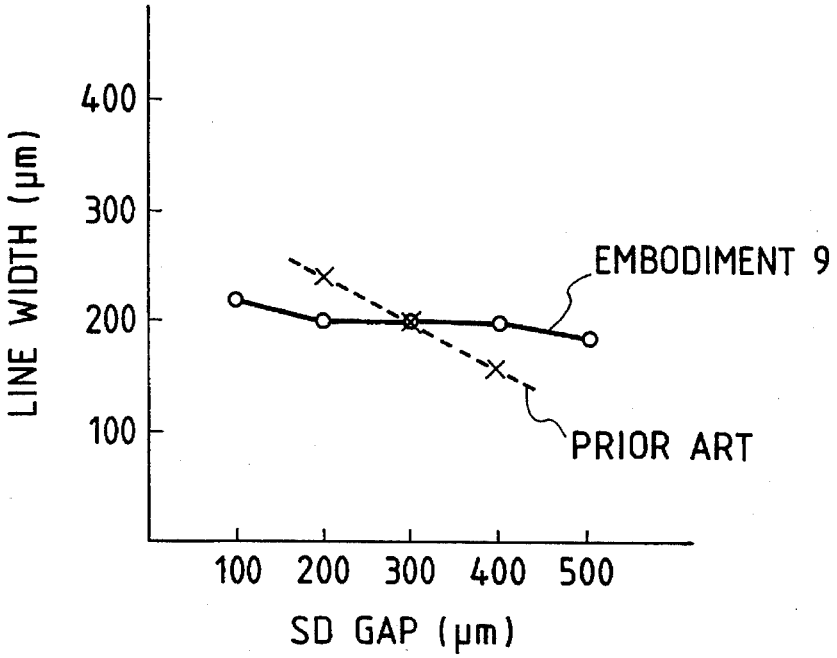
FIG. 25 is a graph for explaining the effect of embodiment 9.
Figure 26:
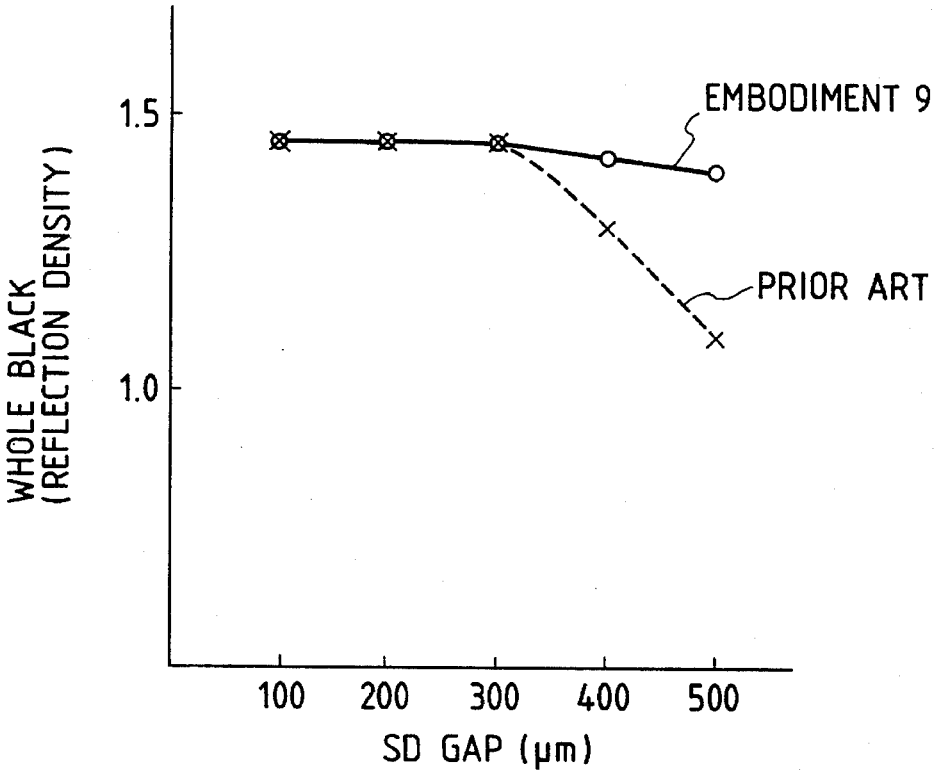
FIG. 26 is a graph for explaining another effect of embodiment 9.

Experiments were conducted by changing the SD gap so as to confirm the effect of this embodiment. FIGS. 25 and 26 show the experimental results. FIG. 25 shows the line width when the SD gap is changed within a range of 100 to 500 μm. According to the effect of the present invention, the line width becomes almost constant (about 200 μm) independently of a change in the SD gap. FIG. 26 shows the density when the SD gap is changed within a range of 100 to 500 μm. According to the effect of the present invention, the density becomes almost constant.

(Embodiment 10)

In embodiment 10, the light emission intensity of the laser 35*a* is controlled using the detected AC current value $i_0$ as in embodiment 3. Upon development, the output from the AC power source 101 is constant-voltage controlled to a predetermined voltage (e.g., a peak-to-peak voltage of 1,700 V) independently of the SD gap size. Other control operations are the same as those in embodiments 3 and 9.

A laser drive current corresponding to each detected AC current value $i_0$ can be obtained from FIGS. 3 and 24. The relationship between the SD gap size and the laser power can be set in the same manner as in embodiment 9.

Figure 27:
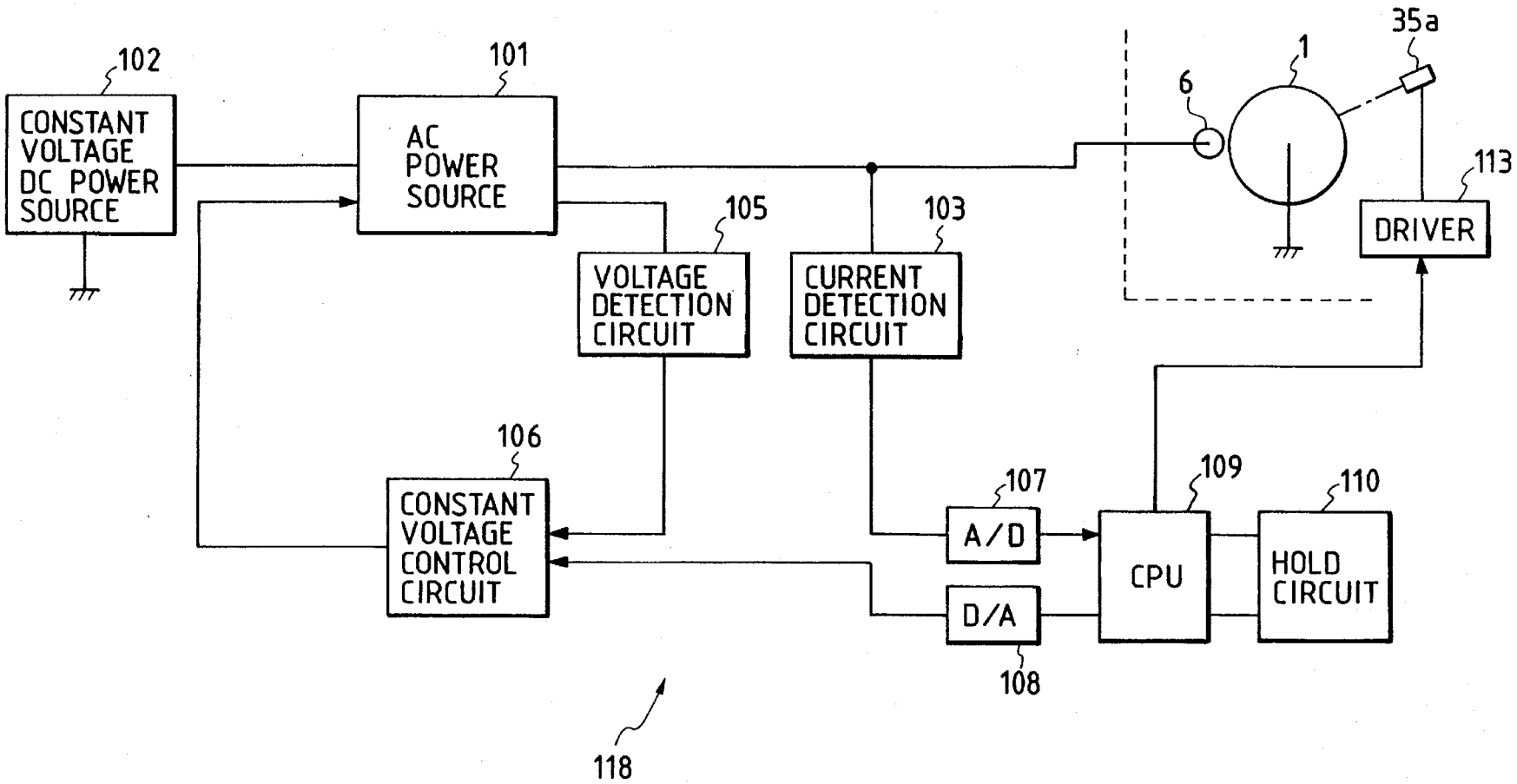
FIG. 27 is a block diagram for explaining a controller of embodiment 10.

FIG. 27 shows the controller 118 of embodiment 10.

(Embodiment 11)

In embodiment 11, when the SD gap is particularly large or small, not only the laser beam amount on the photosensitive drum surface but also the development bias DC voltage are changed. Other control operations are the same as those in embodiment 9 or 10. The laser beam amount is controlled in the same manner as in embodiment 9 or 10.

Figure 28:
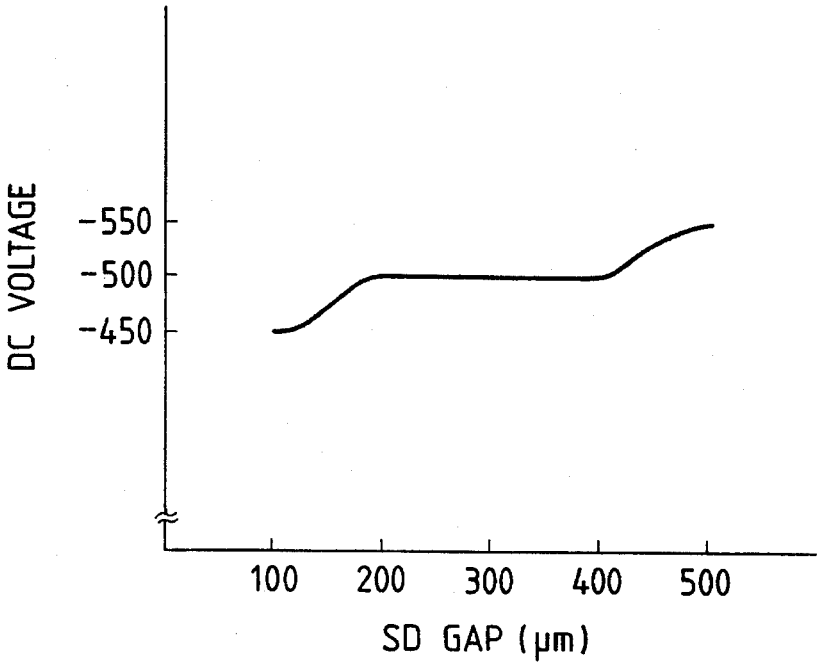
FIG. 28 is a graph for explaining the relationship between the SD gap and the DC voltage in embodiment 11.

The relationship between the SD gap and the DC component of the development bias in embodiment 11 is as shown in FIG. 28. More specifically, when the SD gap is equal to or smaller than 200 μm, even when the laser beam amount is decreased, the line width tends to increase. Therefore, in this case, the development bias DC voltage is lowered to −500 to −450 V. Thus, the contrast between the DC voltage output from the power source 102 and the photosensitive body light portion potential (about −100 to −120 V) corresponding to a character portion is decreased, and the line width can be decreased.

In contrast to this, when the SD gap is equal to or larger than 400 μm, even when the laser beam amount is increased, the line width tends to decrease. Therefore, in this case, the DC voltage output from the power source 102 is increased to −500 to −550 V. Thus, the contrast between the development bias DC voltage and the photosensitive body light portion potential (about −80 to −100 V) increases, and the line width can be increased.

As described above, according to embodiment 11, since not only the laser beam amount but also the DC voltage component of the development bias are controlled in accordance with the SD gap size, stability of the line width and density equivalent to or more than that in embodiments 9 and 10 can be obtained.

Note that the DC power source 102 can be controlled to establish the relationship shown in FIG. 28 using the detected AC voltage $V_{D0}$ (corresponding to the SD gap) or the detected AC current $i_0$ (corresponding to the SD gap).

In the embodiments described so far, a drum having a drum sensitivity near 2.4 μJ/cm$^2$ is exemplified. However, the present invention is not limited to this. For example, according to the present invention, a high-sensitivity drum (e.g., 0.3 μJ/cm$^2$) can be used.

In each of embodiments 9, 10, and 11, the laser beam optical device 35 is used as exposure means for the photosensitive drum. However, the present invention is not limited to this. For example, exposure means comprising an LED, a shutter array using a liquid crystal, and the like may be used.

In each of the above embodiments, the duty ratio of the AC voltage is 50%. Note that the "duty ratio" means the ratio of the time duration of the bias electric field forming phase per period of the AC voltage. The "bias electric field" is an electric field for applying a force in a direction from the development sleeve toward the photosensitive drum to the toner. In contrast to this, an electric field for applying a force in a direction from the photosensitive drum toward the development sleeve to the toner will be referred to as a reverse bias electric field hereinafter.

If the time duration of the bias electric field forming phase during one period is represented by $T_1$, and the time duration of the reverse bias electric field forming phase is represented by $T_2$, the duty ratio is given by $T_1/(T_1+T_2)$.

In embodiments to be described hereinafter, the duty ratio of the AC voltage upon development is controlled.

(Embodiment 12)

Figure 29:
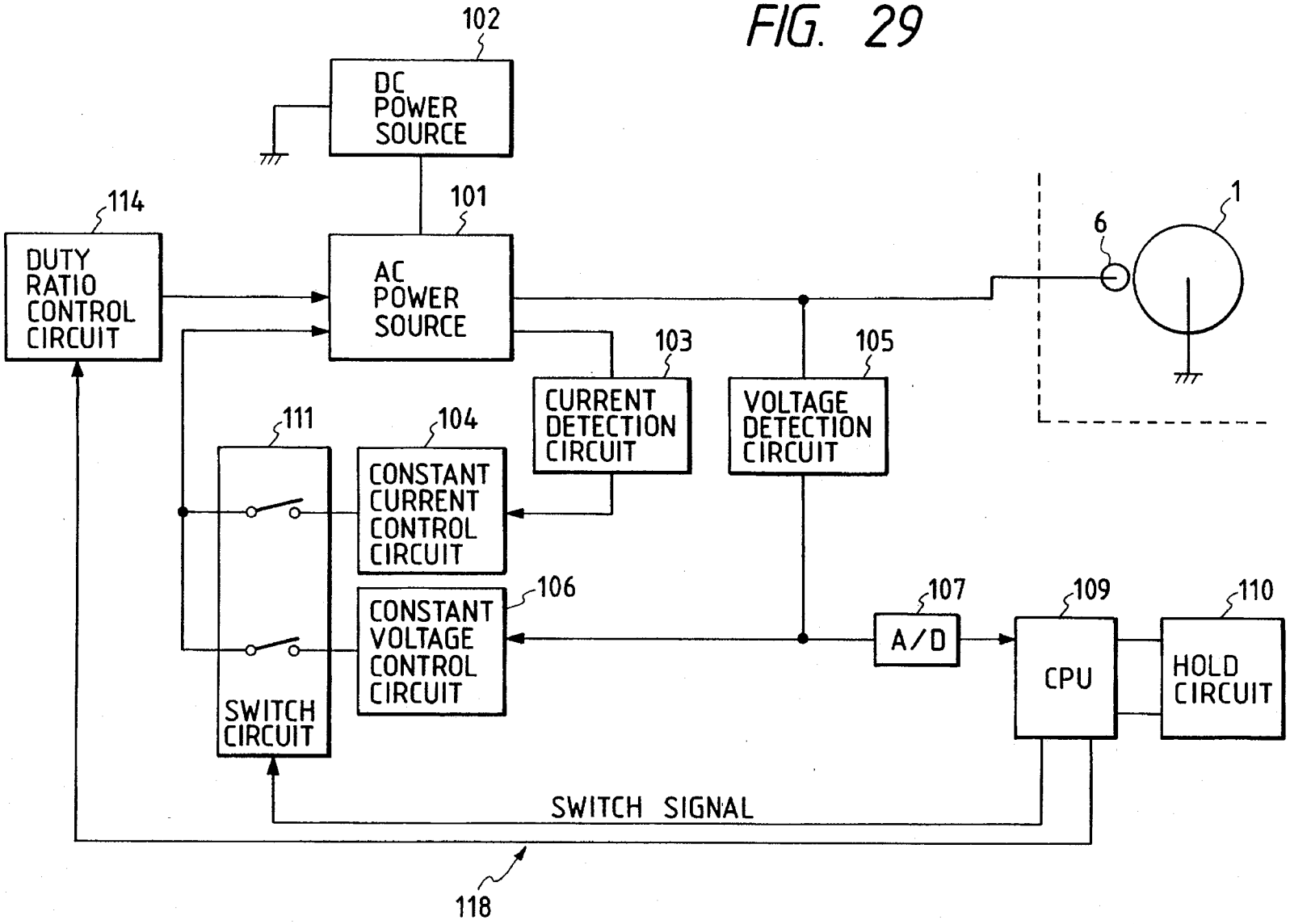
FIG. 29 is a block diagram for explaining a controller of embodiment 12.
Figure 30:
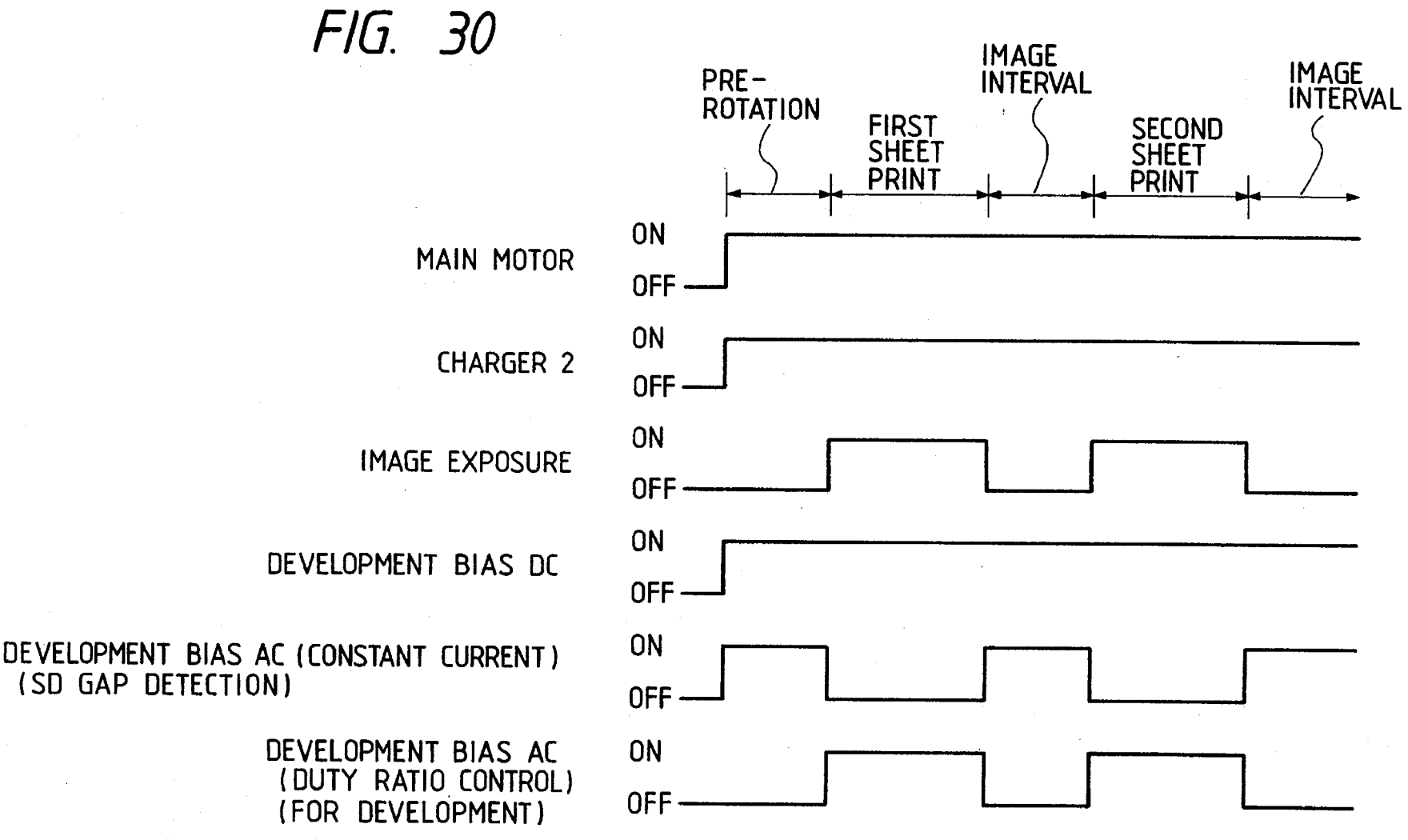
FIG. 30 is a timing chart for explaining the operation sequence of embodiment 12.

FIG. 29 shows a controller of embodiment 12, and FIG. 30 shows its operation sequence.

In this embodiment, the CPU 109 controls the switch circuit 111 to connect the AC power source 101 to the constant current control circuit 104, and sets a predetermined duty ratio (e.g., 50%) in a duty ratio control circuit 114 for controlling the duty ratio of the output from the AC power source 101 in pre-rotation and in image interval. Thus, the AC power source 101 outputs an AC voltage which has a predetermined duty ratio and is constant-current controlled to a predetermined current value (e.g., 2 mA).

Then, the AC voltage value $V_{D0}$ applied to the sleeve 6 at this time is detected by the voltage detection circuit 105. The detected voltage value $V_{D0}$ corresponds to the SD gap size, as described above.

The CPU 109 calculates a duty ratio DR of an AC voltage component to be applied to the sleeve upon development on the basis of the detected AC voltage value $V_{D0}$, and causes the hold circuit 110 to maintain the calculated value.

Upon development, the CPU 109 sets the calculated duty ratio DR in the duty ratio control circuit 114, and controls the switch circuit 111 to connect the constant voltage control circuit 106 to the AC power source 101. Thus, the AC power source outputs an AC voltage which is constant-voltage controlled to a predetermined peak-to-peak voltage (e.g., 1,600 V) and has a duty ratio of the value DR.

Note that the DC power source outputs a predetermined voltage, e.g., a DC voltage of −500 V in pre-rotation, in image interval, and during development. The frequency of the output from the AC power source 101 has a predetermined value (e.g., 1.8 kHz) in pre-rotation, in image interval, and during development.

Figure 31:
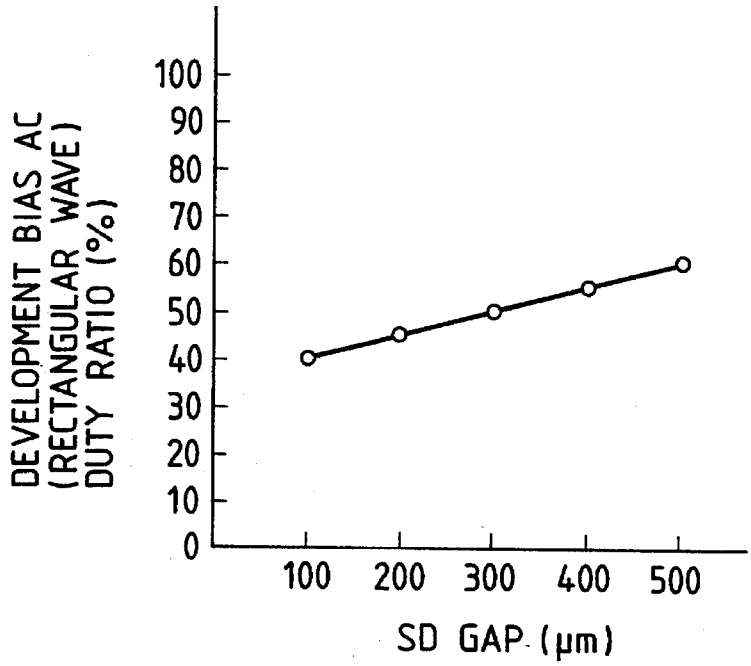
FIG. 31 is a graph for explaining the relationship between the SD gap and the duty ratio in embodiment 12.

As described above, the detected AC voltage $V_{D0}$ corresponds to the SD gap size, as shown in FIG. 4, and the SD gap and the duty ratio DR have the relationship shown in FIG. 31 therebetween. Therefore, the CPU 109 can calculate the duty ratio DR on the basis of the detected voltage $V_{D0}$.

The calculation of the duty ratio will be described in more detail below. For example, when the SD gap is 100 μm, since the line width increases and a character is undesirably painted in the prior art, a duty ratio of 40% is set in this embodiment to shorten the bias electric field forming time and to prolong the reverse bias electric field forming time. The time average value of the development bias voltage at this time is −340 V. Thus, an increase in line width when SD=100 μm can be prevented.

When the SD gap is 500 μm, since the line width decreases and a decrease in density occurs in the prior art, a duty ratio of 60% is set to prolong the bias electric field forming time, and to shorten the reverse bias electric field forming time. At this time, the time average value of the development bias voltage is −660 V. Thus, a decrease in line width and a decrease in density when the SD gap=500 μm can be prevented.

Figure 33:
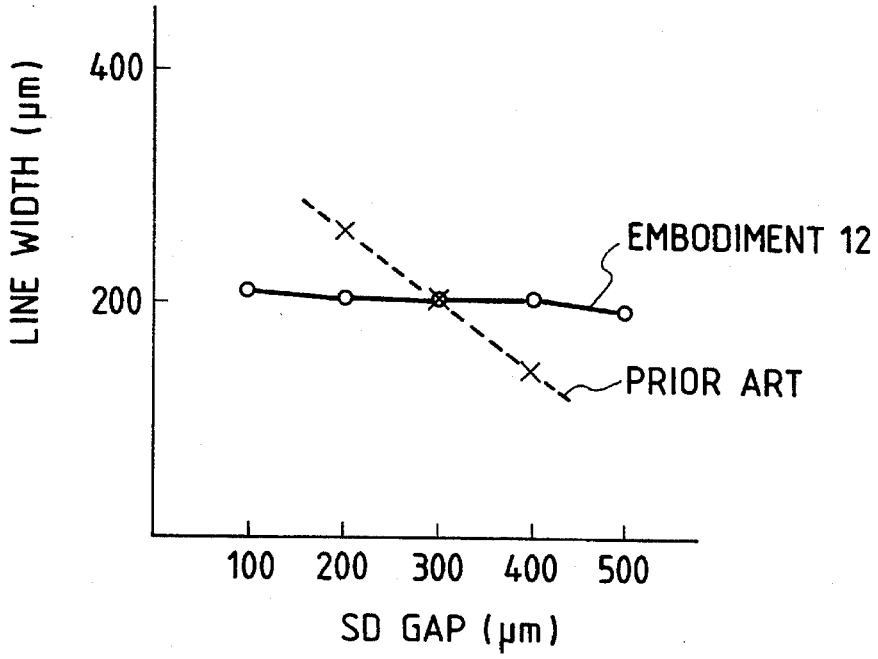
FIG. 33 is a graph for explaining the effect of embodiment 12.
Figure 32:
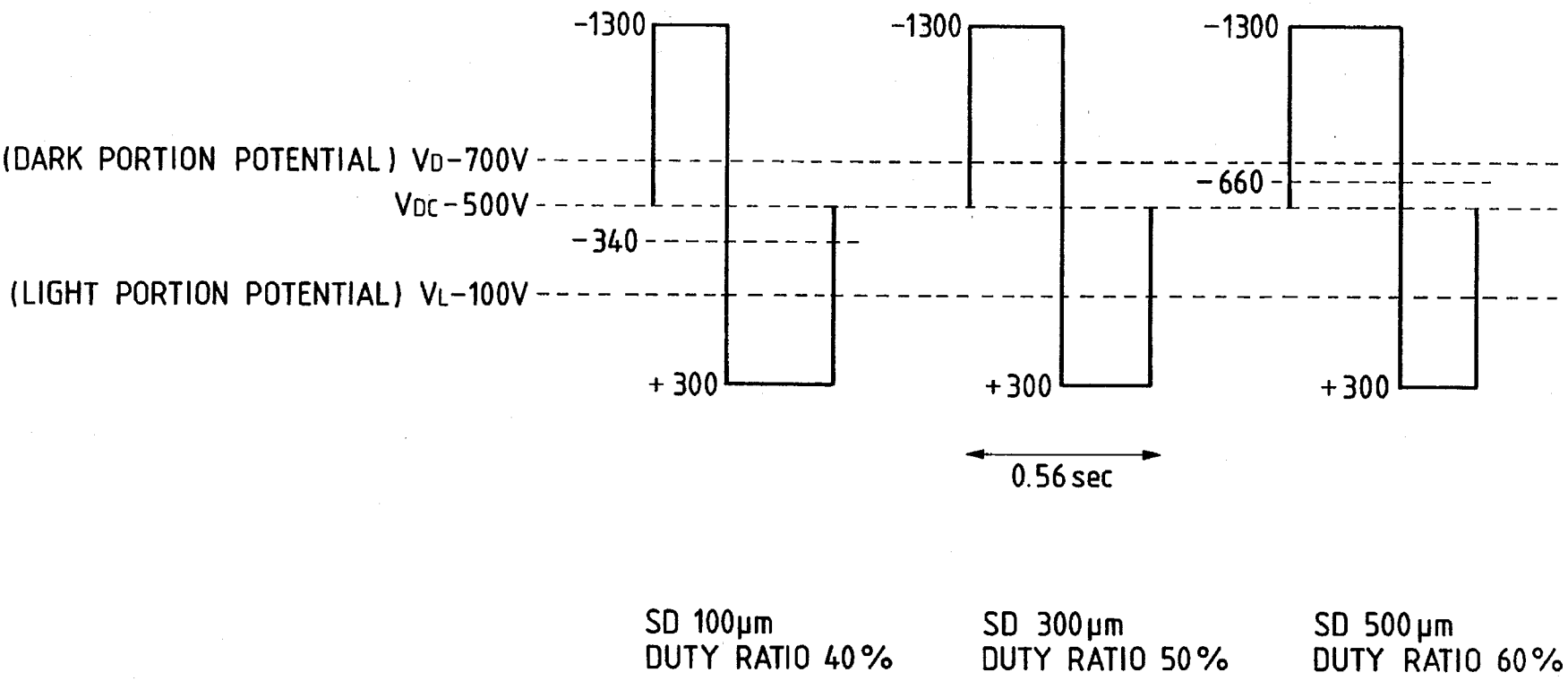
FIG. 32 is a waveform chart for explaining a waveform of a development bias voltage in embodiment 12.

FIG. 32 shows the development bias voltage waveform for one period when the SD gap=100 μm, 300 μm, and 500 μm. FIG. 31 shows the relationship between the SD gap and the duty ratio control value in this embodiment. With this control, according to this embodiment, the line width can be maintained almost constant within the SD gap range of 100 μm to 500 μm. FIG. 33 shows the effect of this embodiment.

Figure 34:
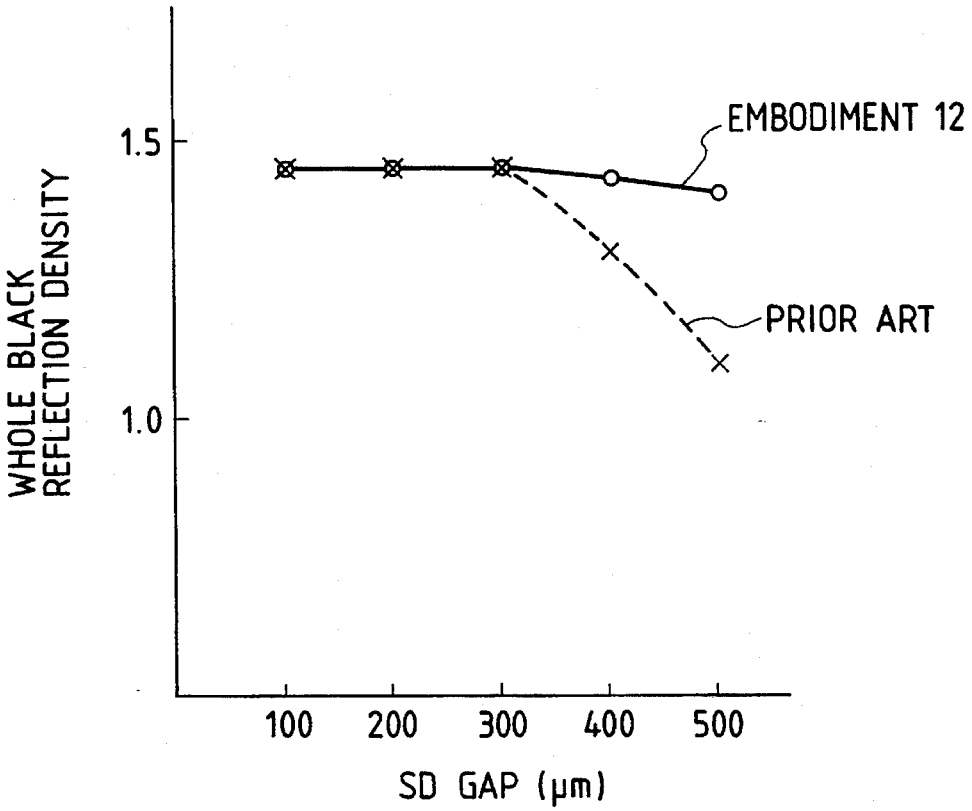
FIG. 34 is a graph for explaining another effect of embodiment 12.

With the control of this embodiment, the density can also be maintained to be almost constant within the SD gap range of 100 μm to 500 μm, as shown in FIG. 34.

(Embodiment 13)

A difference between embodiments 13 and 12 is as follows. In embodiment 13, in pre-rotation and in image interval, the AC power source 101 is controlled to output an AC voltage which is constant-voltage controlled to a predetermined voltage $V_R$ (e.g., a peak-to-peak value of 800 V) and has a duty ratio of 50% as in embodiment 3, and an AC current $i_0$ flowing through the sleeve at that time is detected by the detection circuit 103. The CPU 109 then controls the duty ratio DR of the output from the AC power source 101 upon development on the basis of the detected current value $i_0$. Other control operations are the same as those in embodiment 12.

The relationship between the SD gap corresponding to the AC voltage having the predetermined peak-to-peak value, and the AC current is as shown in FIG. 3, and the relationship between the SD gap and the duty ratio is as shown in FIG. 31. Therefore, the CPU can calculate the corresponding duty ratio DR on the basis of the AC current value $i_0$.

In this embodiment, the output from the AC power source 101 has a peak-to-peak value of 800 V upon detection of the AC current value $i_0$, and is set to have a peak-to-peak value of 1,600 V upon development.

Figure 35:
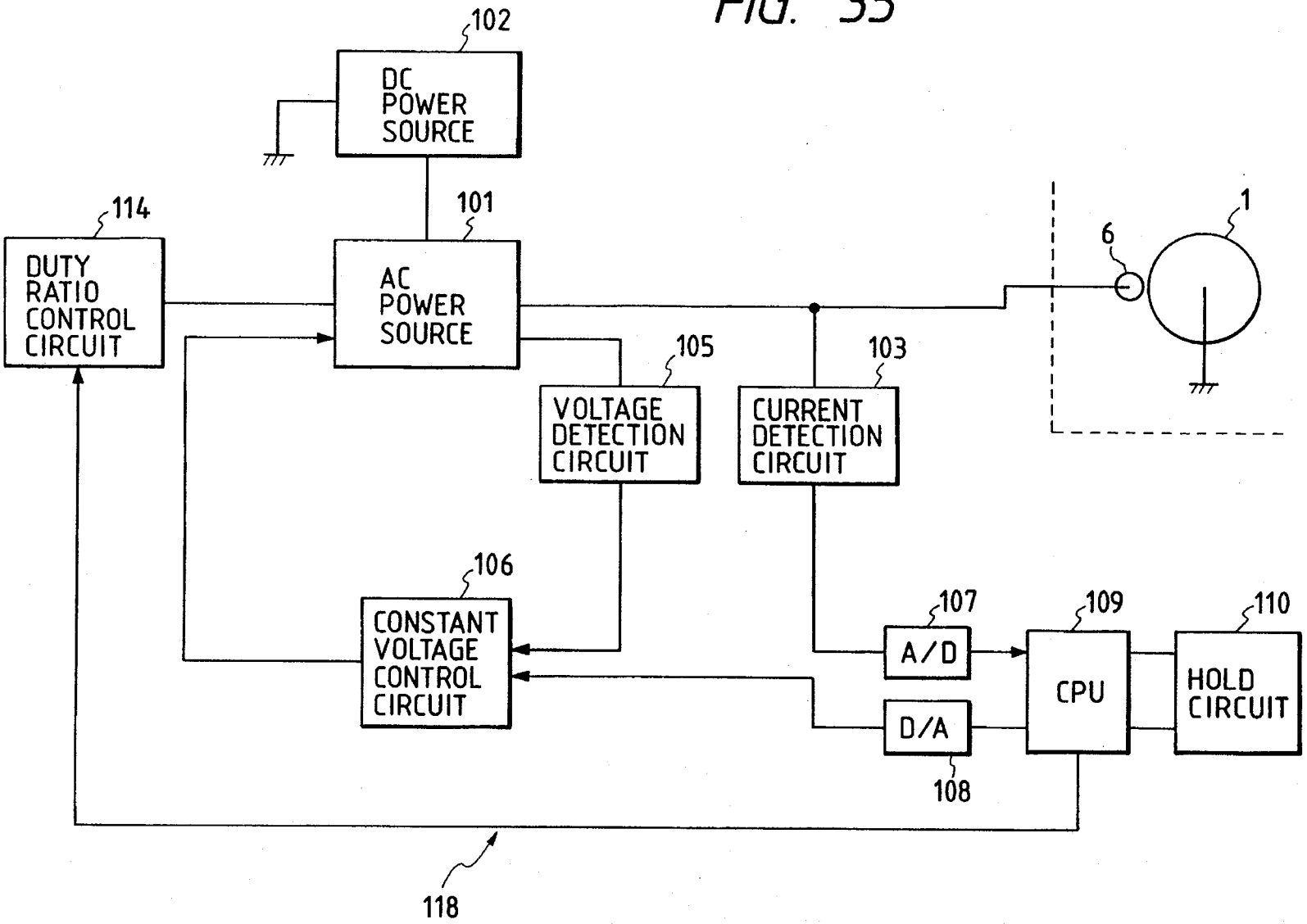
FIG. 35 is a block diagram for explaining a controller of embodiment 13.

FIG. 35 shows a controller of embodiment 13.

In this embodiment as well, the same effect as in FIGS. 33 and 34 can be obtained.

(Embodiment 14)

In embodiment 14, not only the duty ratio of the AC voltage but also the maximum and minimum values of the AC voltage are controlled on the basis of the detected AC voltage or the detected AC current.

More specifically, in this embodiment, the maximum and minimum values are changed to maintain a constant time average value of a periodic bias voltage to be applied to the sleeve even when the duty ratio changes. Thus, in this embodiment, the CPU 109 controls the maximum and minimum values of the periodic bias voltage in correspondence with the duty ratio, so that the integrated value of voltage values for one period of the periodic bias voltage becomes equal to the output voltage from the DC power source 102, i.e., the DC component value of the periodic bias voltage.

Figure 36:
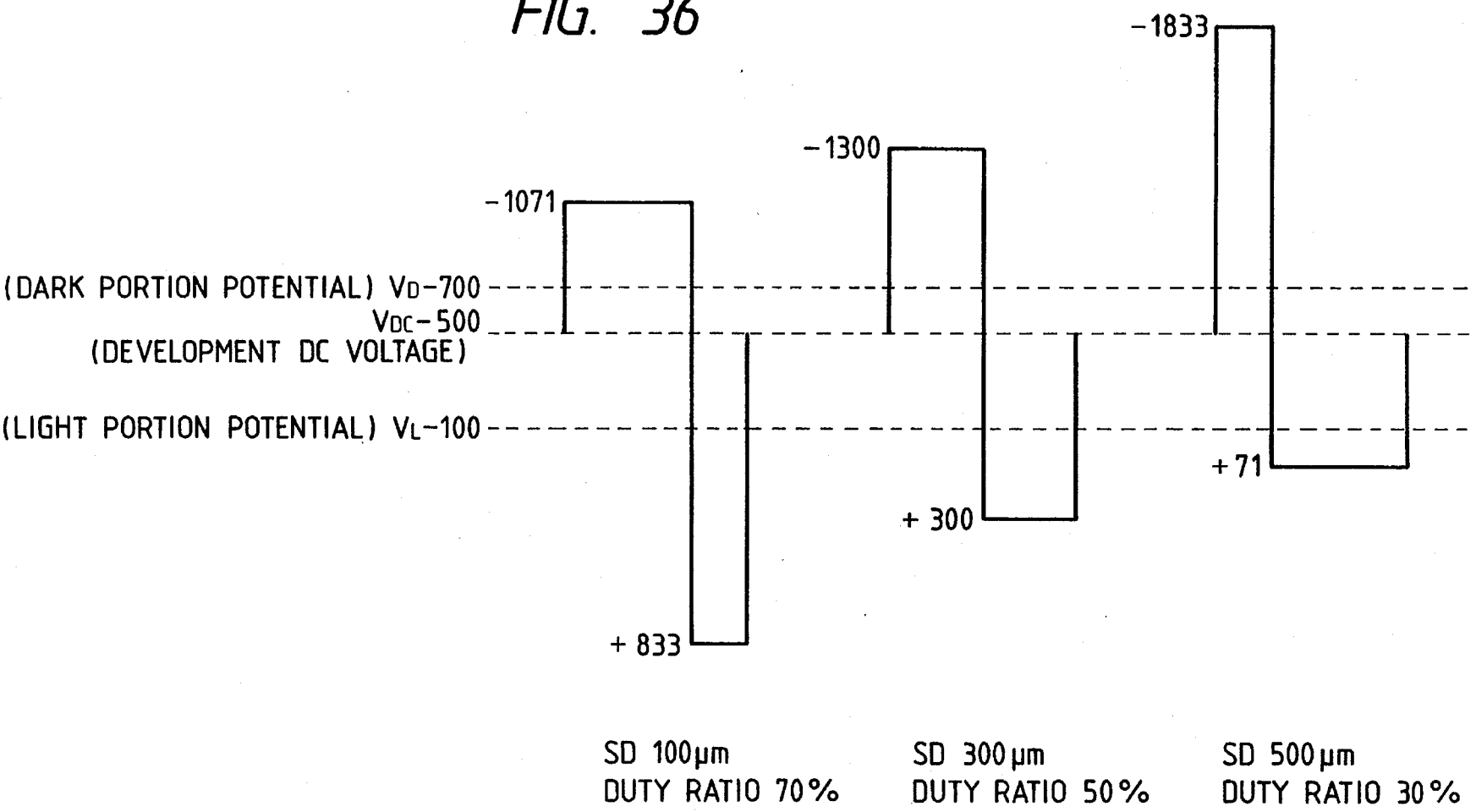
FIG. 36 is a waveform chart for explaining a development bias voltage waveform in embodiment 14.

FIG. 36 shows the development bias waveform (rectangular wave) for one period when the SD gap=100, 300, and 500 μm in embodiment 14. For example, when the SD gap is 100 μm, the duty ratio is set to be 70%, the bias electric field on the light portion potential region is weakened, and the reverse bias electric field on the light portion potential region is strengthened. When the SD gap is 500 μm, the duty ratio is set to be 30%, the bias electric field on the light portion potential region is strengthened, and the reverse bias electric field on the light portion potential region is weakened.

Figure 37:
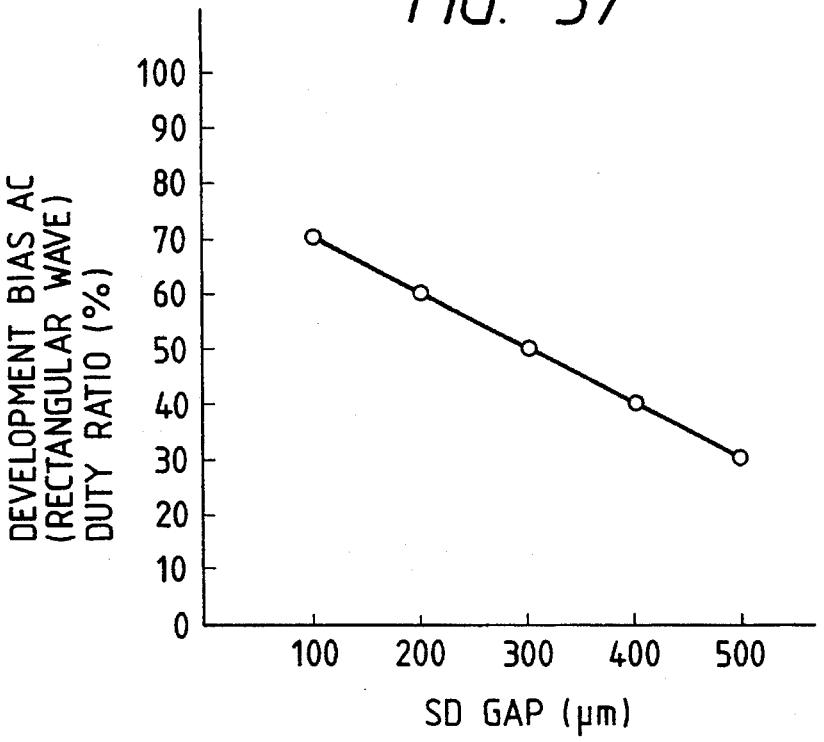
FIG. 37 is a graph for explaining the relationship between the SD gap and the duty ratio in embodiment 14.

That is, in this embodiment, a constant line width is maintained by controlling the bias electric field strength (corresponding to the minimum value of the periodic bias voltage), and a constant image density is maintained by controlling the duty ratio. Therefore, in this embodiment, the relationship between the SD gap and the duty ratio is as shown in FIG. 37. As shown in FIG. 37, the inclination of a line is opposite to that of a line in FIG. 31 corresponding to embodiments 12 and 13.

In embodiments 12 and 13, since the line width is controlled by the bias electric field forming time, when, for example, the SD gap is small, the duty ratio is decreased to prevent an increase in line width which occurs in the prior art.

In contrast to this, in embodiment 14, for example, when the SD gap is small, the bias electric field is decreased to prevent an increase in line width. Since the image density decreases accordingly, the duty ratio is increased to prevent a decrease in image density in embodiment 14.

In any case, in embodiment 14, since the time average value (the integrated value of voltage values for one period) of the vibration bias voltage is constant, even when an abnormal toner which is charged to a polarity opposite to that for developing a latent image is mixed in the development agent, generation of fog which occurs upon attachment of this abnormal toner to a dark portion potential region can be suppressed.

In each of the embodiments described above, the AC voltage or AC current is detected not only in pre-rotation but also in an image interval. Alternatively, the AC voltage or AC current may be detected in only pre-rotation, and image formation conditions may be controlled based on the detected voltage or current.

In each of the embodiments described above, the timing at which development bias control for SD gap detection is switched to control for development is simultaneous with the timing at which a non-image region is switched to an image region. However, an actual switching operation in a bias power source requires several to several hundreds of msec, and the present invention includes switching of the control for development earlier by the time required for the above-mentioned switching operation, as a matter of course.

In each of the embodiments described above, a negative latent image is reverse-developed using a negatively charged toner. However, the present invention can be applied to an apparatus for reverse-developing a positive latent image using a positively charged toner. Furthermore, the present invention can also be applied to an apparatus for normal-developing a latent image.

Also, the present invention can be applied to an apparatus using a non-magnetic one-component development agent, and an apparatus using a two-component development agent.

Furthermore, the present invention can be applied to an apparatus which uses a belt-shaped or solid cylindrical development agent bearing member, and uses a belt-shaped image bearing member.

Moreover, the present invention can be applied to an apparatus of a so-called contact development type, in which a development agent layer carried on a development agent bearing member is brought into contact with an image bearing member in a development region.

The present invention is particularly effective for an image forming apparatus which can detachably load a process cartridge. The present invention can also be applied to an image forming apparatus which can separately attach/detach a photosensitive body or a development device.

In each of the above-mentioned embodiments, a rectangular wave AC voltage is used. The present invention can also be applied to an apparatus which uses a sine wave AC voltage or a triangular wave AC voltage.

The present invention can also be applied to a development device which uses a periodic bias voltage whose maximum value and/or minimum value assume or assumes an intermediate value between the dark and light portion potential values of an electrostatic latent image.

What is claimed is:

1. An image forming apparatus, comprising:

an image bearing member for bearing an electrostatic image thereon;

a developer agent bearing member, opposed to said image bearing member, for bearing and conveying a developing agent;

AC signal applying means for applying a constant current AC signal to said developer agent bearing member;

detection means for detecting a voltage value of said developer agent bearing member to which the constant current AC signal is applied; and control means for controlling an image forming condition in accordance with a voltage value detected by said detection means.

2. An image forming apparatus according to claim 1, further comprising bias applying means for applying a developing bias to said developer agent bearing member, the developing bias being controlled by said control means.

3. An image forming apparatus according to claim 2, wherein the developing bias includes an AC voltage component, a peak to peak value of the AC voltage component being controlled by said control means.

4. An image forming apparatus according to claim 2, wherein the developing bias has a pulse waveform, a duty ratio of the developing bias being controlled by said control means.

5. An image forming apparatus according to claim 1, further comprising electrostatic image forming means for forming an electrostatic image on said image bearing member, said control means controlling an electrostatic image forming condition of said electrostatic image forming means.

6. An image forming apparatus according to claim 1, wherein said control means controls the image forming condition in accordance with the voltage value detected by said detection means in a state where said developer agent bearing member opposes a non-image area of said image bearing member.

7. An image forming apparatus according to claim 1, further comprising a spacer member for regulating a gap between said image bearing member and said developer agent bearing member.

8. An image forming apparatus, comprising:

an image bearing member for bearing an electrostatic image thereon;

a developer agent bearing member, opposed to said image bearing member, for bearing and conveying a developing agent;

AC signal applying means for applying a constant voltage AC signal to said developer agent bearing member;

detection means for detecting a current value of said developer agent bearing member to which the constant voltage AC signal is applied; and control means for controlling an image forming condition in accordance with a current value detected by said detection means.

9. An image forming apparatus according to claim 8, further comprising bias applying means for applying a developing bias to said developer agent bearing member, the developing bias being controlled by said control means.

10. An image forming apparatus according to claim 9, wherein the developing bias has an AC voltage component, a peak to peak value of the AC voltage component being controlled by said control means.

11. An image forming apparatus according to claim 9, wherein the developing bias has a pulse waveform, a duty ratio of the developing bias being controlled by said control means.

12. An image forming apparatus according to claim 8, further comprising electrostatic image forming means for forming an electrostatic image on said image bearing member, said control means controlling an electrostatic image forming condition of said electrostatic image forming means.

13. An image forming apparatus according to claim 8, wherein said control means controls the image forming condition in accordance with the current value detected by said detection means in a state where said developer agent bearing member opposes a non-image area of said image bearing member.

14. An image forming apparatus according to claim 8, further comprising a spacer member for regulating a gap between said image bearing member and said development agent bearing member.

* * * * *

UNITED STATES PATENT AND TRADEMARK OFFICE

CERTIFICATE OF CORRECTION

PATENT NO. : 5,521,683

DATED : May 28, 1996

INVENTOR(S) : TOSHIO MIYAMOTO, et al.

It is certified that error appears in the above-indentified patent and that said Letters Patent is hereby corrected as shown below:

COLUMN 2

Line 17, "view of" should read --view--.

COLUMN 13

Line 67, "Mount" should read --amount--.

Signed and Sealed this

Fifth Day of November, 1996

Bruce Lehman

*Attest:*

BRUCE LEHMAN

*Attesting Officer*

*Commissioner of Patents and Trademarks*